US005487968A

United States Patent [19]

Mizukawa et al.

[11] Patent Number: 5,487,968

[45] Date of Patent: Jan. 30, 1996

[54] SILVER HALIDE PHOTOGRAPHIC MATERIAL

[75] Inventors: Yuki Mizukawa; Hidetoshi Kobayashi, both of Kanagawa, Japan

[73] Assignee: Fuji Photo Film Co., Ltd., Kanagawa, Japan

[21] Appl. No.: 321,980

[22] Filed: Oct. 12, 1994

[30] Foreign Application Priority Data

Oct. 12, 1993 [JP] Japan ..... 5-277332

[51] Int. Cl.[6] ..... G03C 7/305

[52] U.S. Cl. ..... 430/544; 430/614; 430/615; 430/957

[58] Field of Search ..... 430/544, 957, 430/382, 615, 614

[56] References Cited

U.S. PATENT DOCUMENTS

| | | | |
|---|---|---|---|
| 2,362,519 | 11/1942 | Woodward | 430/543 |
| 2,569,906 | 10/1951 | Starke | 430/543 |
| 2,713,541 | 7/1955 | Allen et al. | 430/614 |
| 3,575,699 | 4/1971 | Bloom et al. | 430/614 |
| 3,933,500 | 1/1976 | Shiba et al. | 96/74 |
| 4,477,563 | 10/1984 | Ichijima et al. | 430/544 |
| 4,618,571 | 10/1986 | Ichijima et al. | 430/505 |
| 4,870,000 | 9/1989 | Bergthaller et al. | 430/544 |
| 5,006,452 | 4/1991 | Bucci | 430/544 |
| 5,021,331 | 1/1991 | Vetter | 430/544 |
| 5,200,306 | 4/1993 | Odenwalder et al. | 430/505 |

*Primary Examiner*—Richard L. Schilling
*Attorney, Agent, or Firm*—Sughrue, Mion, Zinn, Macpeak & Seas

[57] ABSTRACT

A silver halide photographic material having at least one silver halide emulsion layer and at least one compound represented by a general formula (I) on a support:

$$A\text{-}(TIME)_m\text{-}(RED)_n\text{-}Q \qquad (I)$$

wherein A represents a group capable of releasing $(TIME)_m$-$(RED)_n$-Q by a reaction with an oxidation product of an aromatic primary amine developing agent;

TIME represents a timing group capable of releasing $(RED)_n$-Q after having been released from A;

RED represents a group capable of releasing Q by reaction with an oxidation product of an aromatic primary amine developing agent after having been released from TIME;

Q represents a group of the following general formula (II);

m represents 0, 1 or 2;

n represents 0 or 1; and when m is 2, two TIME groups may be the same or different:

(II)

wherein M has at least one of oxygen, sulfur and nitrogen atoms and represents a non-metallic atomic group necessary for forming a 5-membered, 6-membered or 7-membered hetero-ring along with the two carbon atoms in the 1,2,3-triazole ring moiety in the formula;

G represents a substituent;

f represents 0 or an integer of from 1 to 5; and when f is 2 or more, two or more G groups may be the same or different; and (*) indecates the position at which the group bonds to $A\text{-}(TIME)_m\text{-}(RED)_n$-.

10 Claims, No Drawings

SILVER HALIDE PHOTOGRAPHIC MATERIAL

FIELD OF THE INVENTION

The present invention relates to a silver halide photographic material and, more precisely, to that having an excellent coloring property, excellent graininess and sharpness, an excellent interlayer effect and excellent color reproducibility.

BACKGROUND OF THE INVENTION

Recently, in the field of photography, it is strongly desired to develop high-sensitivity photographic materials having excellent sharpness and color reproducibility.

As one means for improving the sharpness of photographic materials, it is known to use compounds which release a development inhibitor (DIR compounds) after the reaction of the compounds with the oxidation product of a developing agent. It is well known that the incorporation of such compounds into photographic emulsions results in the increase in the sharpness of color images to be formed due to their edge effect and also in the improvement in their color reproducibility due to their interlayer effect. For such DIR compounds, the development inhibiting effect and the diffusibility of the development inhibitor to be released therefrom during development are important factors. Compounds that have high interactivity with silver halides and have suitable hydrophobicity and diffusibility are suitable as development inhibitors. As DIR compounds capable of releasing such development inhibitors, for example, DIR compounds having a 1,2,3-triazole development inhibitor are known. Precisely, DIR couplers having a monocyclic triazole development inhibitor such as those described in EP 272573 and 401612 (corresponding to U.S. Pat. Nos. 5,200,306 and 5,021,331, respectively) and DIR couplers having a benzotriazole development inhibitor such as those described in U.S. Pat. Nos. 3,617,291, 3,933,500, 4,477,563 and 5,006,452 are known. However, the former DIR couplers having a monocyclic 1,2,3-triazole development inhibitor were disadvantageous with respect to the sharpness and the color reproducibility, since the development inhibiting effect of the development inhibitors to be released from them is low. The latter DIR compounds having a benzotriazole development inhibitor have an excellent interlayer effect, but further improvement of them in their sharpness was still desired.

Recently, rapid processing of photographic materials has become desired increasingly, therefore couplers having an excellent coloring property are desired.

As mentioned above, further improvement of the conventional DIR compounds having a monocyclic triazole development inhibitor in their sharpness, graininess and interlayer effect was desired. On the other hand, the conventional DIR compounds having a benzotriazole development inhibitor have an excellent interlayer effect, but further improvement of them in their sharpness and graininess was still desired. As DIR compounds themselves, those that may react rapidly with oxidation products of developing agents and those that are stable as DIR compounds have been desired.

SUMMARY OF THE INVENTION

Accordingly, the first object of the present invention is to provide a silver halide photographic material containing a stable DIR compound having a high activity. The second object of the present invention is to provide silver halide photographic materials having an excellent interlayer effect and having improved sharpness and graininess.

The above-mentioned objects of the present invention can be attained by a silver halide photographic material having at least one silver halide emulsion layer and at least one compound represented by a general formula (I) on a support:

$$A\text{-}(TIME)_m\text{-}(RED)_n\text{-}Q \qquad (I)$$

wherein A represents a group capable of releasing $(TIME)_m$-$(RED)_n$-Q by a reaction with an oxidation product of an aromatic primary amine developing agent;

TIME represents a timing group capable of releasing $(RED)_n$-Q after having been released from A;

RED represents a group capable of releasing Q by reaction with an oxidation product of an aromatic primary amine developing agent after having been released from TIME;

Q represents a group of the following general formula (II);

m represents 0, 1 or 2;

n represents 0 or 1; and when m is 2, two TIME groups may be the same or different.

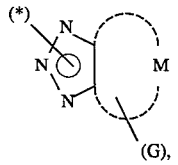

(II)

wherein M has at least one of oxygen, sulfur and nitrogen atoms and represents a non-metallic atomic group necessary for forming a 5-membered, 6-membered or 7-membered hetero-ring along with the two carbon atoms in the 1,2,3-triazole ring moiety in the formula;

G represents a substituent;

f represents 0 or an integer of from 1 to 5; and when f is 2 or more, two or more G groups may be the same or different; and (*) indecates the position at which the group bonds to $A\text{-}(TIME)_m\text{-}(RED)_n$-.

DETAILED DESCRIPTION OF THE INVENTION

Next, the present invention will be explained in more detail hereunder.

In the compounds of formula (I), A represents a group capable of releasing $(TIME)_m$-$(RED)_n$-Q by a reaction with an oxidation product of an aromatic primary amine developing agent and it includes, for example, coupler residues such as yellow coupler residues, magenta coupler residues or cyan coupler residues, and oxidizable mother nuclei that may be oxidized with oxidation products of developing agents to release $(TIME)_m$-$(RED)_n$-Q.

More precisely, when A represents yellow coupler residues, examples of them include residues of couplers of pivaloylacetanilides, benzoylacetanilides, malonic diesters, malondiamides, dibenzoylmethanes, benzothiazolylacetamides, malonic ester monoamides, benzoxazolylacetamides, benzimidazolylacetamides and cycloalkanoylacetamides, and the coupler residues as described in U.S. Pat. Nos. 5,021,332 and 5,021,330 and EP 421,221A.

When A represents magenta coupler residues examples of them include residues of couplers of 5-pyrazolones, pyrazolobenzimidazoles, pyrazolotriazoles, pyrazoloimidazoles, imidazotriazoles and cyanoacetophenones.

When A represents cyan coupler residues, examples for them include residues of phenol couplers and naphthol couplers, and the coupler residues as described in U.S. Pat. No. 4,746,602 and EP 249,453.

A may also be a non-coloring coupler residue substantially not leaving any color image in photographic materials. Examples of such coupler residues include residues of couplers of indanones and acetophenones, dissolving coupler residues such as those described in EP 443,530A and 444,501A.

In formula (I), when A is an oxidizable mother nucleus oxidized with an oxidation product of a developing agent to release $(TIME)_m$-$(RED)_n$-Q, then it follows the Kendall-Pelz law and includes, for example, moieties of hydroquinones, catechols, p-aminophenols, 1,2-naphthalene-diols, 1,4-naphthalene-diols, 1,6-naphthalene-diols, 1,2-aminonaphthols, 1,4-aminonaphthols, 1,6-aminonaphthols, galaxies, gallic acid amides, hydrazines, hydroxylamines, pyrazolidones and reductones. Specific examples of such mother nuclei include oxidizable mother nuclei described in JP-A 62-251746 (corresponding to U.S. Pat. No. 4,791,049), JP-A 4-151144 (corresponding to EP 0481427A) and U.S. Pat. No. 4,791,049. (The term "JP-A" as used herein means an "unexamined published Japanese patent application".)

Where A in formula (I) is a coupler residue, it is preferably one chosen from among coupler residues of the following general formulae (Cp-1), (Cp-2), (Cp-3), (Cp-4), (Cp-5), (Cp-6), (Cp-7), (Cp-8), (Cp-9) and (Cp-10). Couplers of these residues are preferred, as having a high coupling rate.

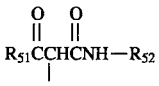
(Cp-1)

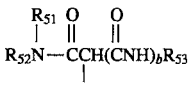
(Cp-2)

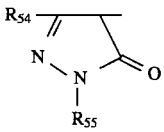
(Cp-3)

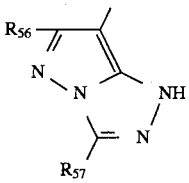
(Cp-4)

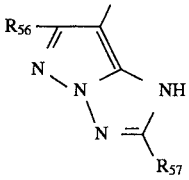
(Cp-5)

-continued

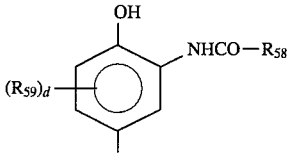
(Cp-6)

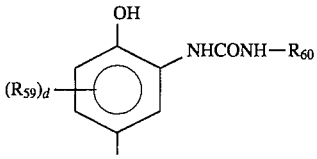
(Cp-7)

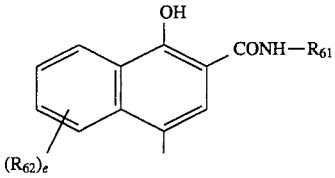
(Cp-8)

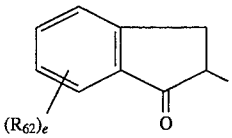
(Cp-9)

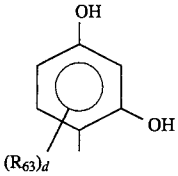
(Cp-10)

In the above-mentioned formulae, the free bond derived from the coupling position indicates the position to which a coupling split-off group is bonded.

In these formulae, where $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ contains a non-diffusive group, it is so selected that the number of all carbon atoms therein is from 8 to 40, preferably from 10 to 30; and in the other cases, the number of all carbon atoms in the group is preferably 15 or less. For bis-type, telomer-type or polymer-type couplers, any of the above-mentioned substituents is divalent and bonds to a repeating unit. In such a case, the above-mentioned range of the number of carbon atoms constituting the substituents does not apply.

$R_{51}$ to $R_{63}$, b, d and e are explained in detail hereunder. In the following description, $R_{41}$ represents an alkyl group, an aryl group or a heterocyclic group; $R_{42}$ represents an aryl group or a heterocyclic group; and $R_{43}$, $R_{44}$ and $R_{45}$ each represent a hydrogen atom, an alkyl group, an aryl group or a heterocyclic group. $R_{51}$ has the same meaning as $R_{41}$. $R_{52}$ and $R_{53}$ each have the same meaning as $R_{43}$. b represents 0 or 1. $R_{54}$ has the same meaning as $R_{41}$ or it represents $R_{41}CO(R_{43})N$-, $R_{41}SO_2(R_{43})N$-, $R_{41}(R_{43})N$-, $R_{41}S$-, $R_{43}O$- or $R_{45}(R_{43})NCON(R_{44})$-.

$R_{55}$ has the same meaning as $R_{41}$. $R_{56}$ and $R_{57}$ each has the same meaning as $R_{43}$ or it represents $R_{41}S$-, $R_{43}O$-, $R_{41}CO(R_{43})N$-, $R_{41}SO_2(R_{43})N$-, $R_{41}(R_{43})N$- or $R_{45}(R_{43})NCON(R_{44})$-.

$R_{58}$ has the same meaning as $R_{41}$. $R_{59}$ has the same meaning as $R_{41}$ or it represents $R_{41}CO(R_{43})N$-, $R_{41}OCO(R_{43})N$-, $R_{41}SO_2(R_{43})N$-, $R_{43}(R_{44})NCO(R_{45})N$-, $R_{41}O$-, $R_{41}S$-, a halogen atom, or $R_{41}(R_{43})N$-. In formulae d represents 0 or an integer of from 1 to 3. Where d is a plural number, plural $R_{59}$'s may be the same or different substituents. $R_{60}$ has the same meaning as $R_{41}$. $R_{61}$ has the same meaning as $R_{41}$. $R_{62}$ has the same meaning as $R_{41}$ or it represents $R_{41}CONH$-, $R_{41}OCONH$-, $R_{41}SO_2NH$-, $R_{43}(R_{44})NCONH$-, $R_{43}(R_{44})NSO_2NH$-, $R_{43}O$-, $R_{41}S$-, a halogen atom or $R_{41}NH$-. $R_{63}$ has the same meaning as $R_{41}$ or it represents $R_{43}CO(R_{44})N$-, $R_{43}(R_{44})NCO$-, $R_{41}SO_2(R_{43})N$-, $R_{41}(R_{43})NSO_2$-, $R_{41}SO_2$, $R_{43}OCO$-, $R_{43}OSO_2$-, a halogen atom, a nitro group, a cyano group or $R_{43}CO$-. In formulae e represents 0 or an integer of from 1 to Plural $R_{62}$'s or $R_{63}$'s, if any, may be the same or different substituents.

The alkyl group as referred to herein is a saturated or unsaturated, acyclic or cyclic, linear or branched, substituted or unsubstituted alkyl group preferably having from 1 to 32 carbon atoms, more preferably from 1 to 22 carbon atoms. As specific examples of the unsubstituted group, mentioned are a methyl, ethyl, cyclopropyl, isopropyl, n-butyl, t-butyl, i-butyl, t-amyl, n-hexyl, 2-ethylhexyl, n-octyl, 1,1,3,3-tetramethylbutyl, n-decyl, n-dodecyl, n-hexadecyl, adamantyl and n-octadecyl groups.

The aryl group as referred to herein preferably is a substituted or unsubstituted phenyl or naphthyl group having from 6 to 20 carbon atoms.

The heterocyclic group as referred to herein is preferably a 3-membered to 8-membered substituted or unsubstituted heterocyclic group preferably having from 1 to 20 carbon atoms, more preferably from 1 to 7 carbon atoms and having at least one of hetero atoms selected from nitrogen atom, oxygen atom and sulfur atom in the heterocyclic ring. The heterocyclic ring may be condensed with a benzene ring. Specific examples of the group include 2-pyridyl, 2-benzoxazolyl, 2-imidazolyl, 2-benzimidazolyl, 1-indolyl, 1,3,4-thiadiazol-2-yl, 1,2,4-triazol-2-yl and 1-indolinyl groups.

Where the alkyl, aryl or heterocyclic group mentioned above has substituent(s), for example, the substituent(s) may be selected from a halogen atom (e.g., F, Cl, Br), $R_{47}O$-, $R_{46}S$-, $R_{47}CO(R_{48})N$-, $R_{47}(R_{48})NCO$-, $R_{47}(R_{48})NSO_2$-, $R_{46}SO_2$-, $R_{47}OCO$-, $R_{47}NCO(R_{48})N$-, $R_{47}CONHSO_2$-, $R_{47}NHCONHSO_2$-, $R_{46}$-, $R_{47}(R_{48})N$-, $R_{46}COO$-, $R_{47}OSO_2$-, a cyano group and a nitro group. $R_{46}$ represents an alkyl group, an aryl group or a heterocyclic group; $R_{47}$ and $R_{48}$ each represent an alkyl group, an aryl group, a heterocyclic group or a hydrogen atom. The alkyl, aryl and heterocyclic groups have the same meanings as defined hereinabove.

Preferred ranges of $R_{51}$ to $R_{63}$, b, d and e are mentioned below.

$R_{51}$ is preferably an alkyl group, an aryl group or a heterocyclic group and b is preferably 1. $R_{52}$, $R_{53}$ and $R_{55}$ each is preferably an aryl group. $R_{54}$ is preferably $R_{41}CONH$- or $R_{41}(R_{43})N$-. $R_{56}$ and $R_{57}$ each is preferably an alkyl group, $R_{41}O$- or $R_{41}S$-.

$R_{58}$ is preferably an alkyl group or an aryl group. In formula (Cp-6), $R_{59}$ is preferably a chlorine atom, an alkyl group or $R_{41}CONH$-. In formulae d is preferably 1 or 2. $R_{60}$ is preferably an aryl group. In formula (Cp-7), $R_{59}$ is preferably $R_4CONH$-, and d is preferably 1. $R_{61}$ is preferably an alkyl group or an aryl group. In formula (Cp-8), e is preferably 0 or 1. $R_{62}$ is preferably $R_{41}OCONH$-, $R_{41}CONH$- or $R_{41}SO_2NH$; and the position of the group is preferably 5-position of the naphthol ring of the formula. In formula (Cp-9), $R_{63}$ is preferably $R_{41}CONH$-, $R_{41}SO_2NH$-, $R_{41}(R_{43})NSO_2$-, $R_{41}SO_2$-, $R_{41}(R_{43})NCO$-, a nitro group or a cyano group. In formula (Cp-10), $R_{63}$ is preferably $R_{43}NHCO$-, $R_{43}OCO$- or $R_{43}CO$-.

The group represented by TIME is explained below.

The group represented by TIME may be any and every linking group capable of releasing $(RED)_n$-Q after it has split off from A during development. For instance, it includes a group of utilizing a cleaving reaction of hemiacetals such as those described in U.S. Pat. Nos. 4,146,396, 4,652,516 and 4,698,297; a timing group of causing a cleaving reaction by utilizing an intramolecular nucleophilic substitution reaction such as those described in U.S. Pat. Nos. 4,248,962, 4,847,185 and 4,857,440; a timing group of causing a cleaving reaction by utilizing an electron transfer reaction such as those described in U.S. Pat. Nos. 4,409,323 and 4,421,845; a group of causing a cleaving reaction by utilizing a hydrolyzing reaction of iminoketals such as those described in U.S. Pat. No. 4,546,073; and a group of causing a cleaving reaction by utilizing a hydrolyzing reaction of esters such as those described in DE (OLS) 2,626,317. TIME bonds to A at the hetero atom therein, preferably at the oxygen atom, sulfur atom or nitrogen atom therein. Preferred examples of TIME include those represented by the following formulae (T-1), (T-2) and (T-3).

$$*—W—(X=Y)_j-C(R_{31})R_{32}—** \quad \text{(T-1)}$$

$$*—W—CO—** \quad \text{(T-2)}$$

$$*—W—LINK—E—** \quad \text{(T-3)}$$

In the methin group formulae, * indicates the position at which the group bonds to A in formula (I); ** indicates the position at which the group bonds to (RED)-Q or to TIME (when m is a plural number) in the same; W represents an oxygen atom, a sulfur atom or >N—$R_{33}$; X and Y each represent a methine group or a nitrogen atom; j represents 0, 1 or 2; and $R_{31}$, $R_{32}$ and $R_{33}$ each represents a hydrogen atom or a substituent. Unlimitedly selected two of the substituents, if any, of X and Y of each being a substituted methine group, and $R_{31}$, $R_{32}$ and $R_{33}$ preferably bonded to each other to form a cyclic structure (for example, benzene ring or pyrazole ring).

Examples of the substituents of X and Y and those represented by $R_{31}$, $R_{32}$ and $R_{33}$ (when they do not form a cyclic structure) are the same as those defined by G and explained hereinafter in detail, X and Y each is preferably an unsubstituted methin group, and $R_{31}$ and $R_{32}$ each preferably is a hydrogen atom. Preferred substituents of the methin group and those represented by $R_{31}$ and $R_{32}$ are a halogen atom, a cyano group, a nitro group, an alkyl group, an alkoxy group, an alkoxycarbonyl group, an acylamino group, a carbamoyl group, a sulfamoyl group, a sulfonamido group, a sulfonyl group, an imido group, and an acyl group. More preferably X and Y each is an unsubstituded methin group, and $R_{31}$ and $R_{32}$ each is a hydrogen atom, and the substituents of the methin group and those represented by $R_{31}$ and $R_{32}$ are a halogen atom, a nitro group, an alkyl group, an alkoxy group, an alkoxycarbonyl group, an acylamino group, a carbamoyl group, a sulfamoyl group, a sulfonamido group, and a sulfonyl group.

$R_{33}$ is preferably a hydrogen atom, an alkyl group an aryl group, an acyl group, or a sulfonyl group, more preferably a hydrogen atom, an alkyl group or an aryl group.

Examples of the substituent represented by $R_{31}$ and $R_{32}$ include an alkyl group and an aryl group, and examples of $R_{33}$ include an alkyl group, an aryl group, an alkylcarbonyl group, an arylcarbonyl group, an alkylsulfonyl group, and an arylsulfonyl group. The alkyl group and the aryl group each has the same definitions as defined for $R_{41}$.

In formula (T-3), E represents an electrophilic group; and LINK represents a linking group for attaining the steric relationship between W and E for the intramolecular nucleophilic substitution reaction therebetween.

Specific examples of TIME of formula (T-1) are mentioned below, which, however, are not limitative.

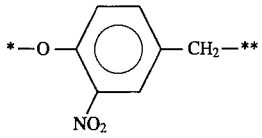

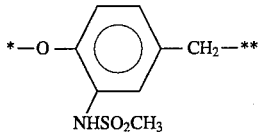

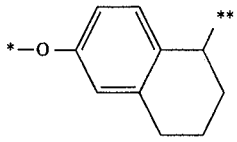

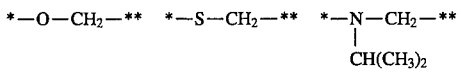

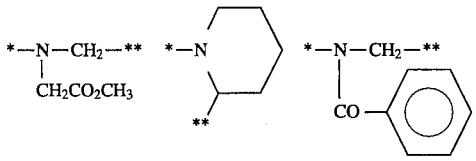

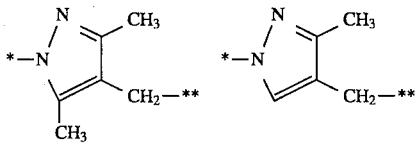

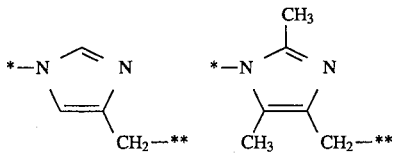

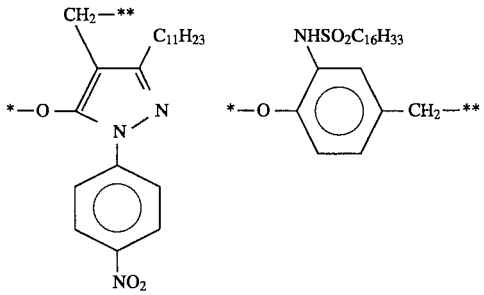

Specific examples of TIME of formula (T-2) are mentioned below, which, however, are not limitative.

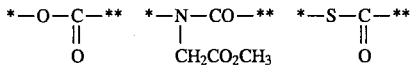

Specific examples of TIME of formula (T-3) are mentioned below, which, however, are not limitative.

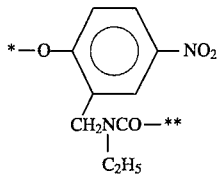

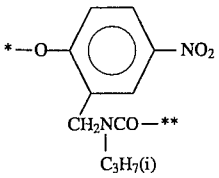

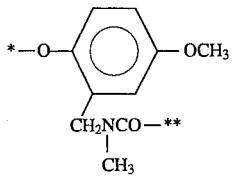

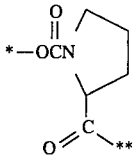

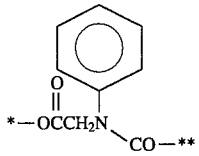

In formula (I) where m is 2 or more, specific examples of $(TIME)_m$ are mentioned below, which, however, are not limitative.

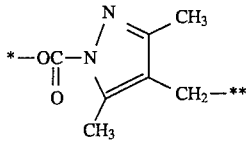

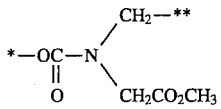

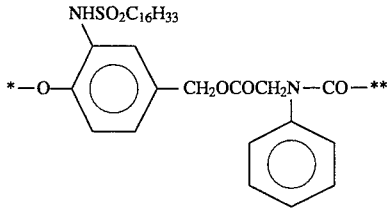

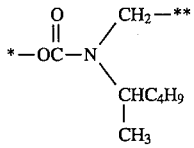

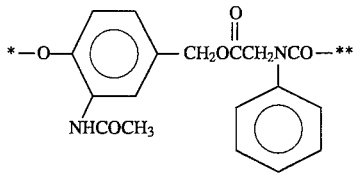

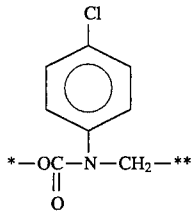

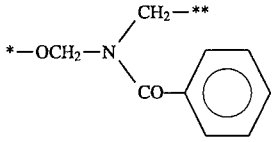

The group of RED in formula (I) will be mentioned in detail hereunder.

In formula (I), $(RED)_n$-Q splits off from A or TIME and is then oxidized with an oxidizing substance existing during development, such as an oxidation product of a developing agent, by cross-oxidation. $(RED)_n$-Q may be any substance that releases Q after having been oxidized. Examples of RED include moieties of hydroquinones, catechols, pyrogallols, 1,2-naphthohydroquinones, 1,4-naphthohydroquinones, sulfonamidophenols, hydrazines and sulfonamidonaphthols. Specific examples of these are described in, for example, JP-A 61-230135, 62-251746, 61-278852 (corresponding to U.S. Pat. Nos. 5,142,029, 4,791,049 and 4,770,982, respectively), U.S. Pat. Nos. 3,364,022, 3,379,529, 4,618,571, 3,639,417, 4,684,604, and *J. Org. Chem.*, Vol. 29, p. 588 (1964).

Of the above examples of RED, preferred are hydroquinones, 1,4-naphthohydroquinones, 2 (or 4)-sulfonamidophenols, pyrogallols and hydrazines. Of these, redox groups having a phenolic hydroxyl group bond to A-$(TIME)_m$- at the oxygen atom of the phenol group.

The group of Q in formula (I) will be mentioned in detail hereunder.

Q is represented by the following general formula (II):

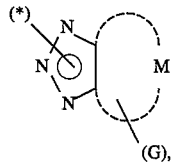

(II)

wherein M has at least one of oxygen, sulfur and nitrogen atoms and represents a non-metallic atomic group necessary for forming a 5-membered, 6-membered or 7-membered hetero-ring along with the two carbon atoms in the 1,2,3-triazole ring moiety in the formula;

G represents a substituent;

f represents 0 or an integer of from 1 to 5; and when f is 2 or more, then two or more G's may be the same or different; and (*) indicates the position at which the group bonds to A-$(TIME)_m$-$(RED)_n$-.

M preferably represents non-metalic atomic group containing (1) at least one oxygen atom only or at least one sulfur atom only, (2) at least one nitrogen atom and at least one of an oxygen atom and a sulfur atom only, or (3) at least one nitrogen atom (preferably two nitrogen atoms) only as hetero atom.

More precisely, G represents a substituent, for example, a halogen atom (e.g., fluorine, chlorine, bromine, iodine), a hydroxyl group, a cyano group, a nitro group, -COOM (wherein M represents, for example, H, an alkali metal atom such as Li, Na and K, and $NH_4$-), an alkyl group (which is linear, branched or cyclic and preferably has from 1 to 20, more preferably 1 to 10 carbon atoms, e.g., methyl, ethyl, n-butyl, t-butyl, butoxycarbonylmethyl, 4-methoxybenzyl, benzyl, butoxymethyl, ethoxycarbonylmethyl, benzoyloxymethyl, ethoxyethoxycarbonylmethyl, phenoxyethoxycarbonylmethyl), an aryl group (preferably having from 6 to 14 carbon atoms, e.g., phenyl, naphthyl, 4-methoxyphenyl, 2-methoxyphenyl, 4-ethoxycarobnylphenyl, 4-phenoxycarbonylphenyl, 3-ethoxyethoxycarbonylphenyl, 2-phenoxyethoxycarbonylphenyl), an alkoxy group (preferably having from 1 to 20, more preferably from 1 to 10 carbon atoms, e.g., methoxy, ethoxy, benzyloxy, ethoxyethoxy, phenoxyethoxy, hexyloxy), an aryloxy group (preferably having from 6 to 10 carbon atoms, e.g., phenoxy, 2-methoxyphenoxy, 4-methoxyphenoxy, 4-chlorophenoxy, 4-methylphenoxy, 2-ethoxycarbonylphenoxy, 4-phenoxycarbonylphenoxy, isoamyloxycarbonylphenoxy, naphthoxy), an alkoxycarbonyl group (preferably having from 2 to 20, more preferably from 2 to 10 carbon atoms, e.g., methoxycarbonyl, isoamyloxycarbonyl, ethoxyethoxycarbonyl, phenoxyethoxycarbonyl), an aryloxycarbonyl group (preferably having from 7 to 21, more preferably from 7 to 11 carbon atoms, e.g., phenoxycarbonyl, 2-methoxyphenoxycarbonyl, naphthyloxycarbonyl), an acylamino group (preferably having from 1 to 20, more preferably from 1 to 10 carbon atoms, e.g., acetamido, butanamido, hexanamido, benzamido, pivaloylamino) (an acyl group or acyl moiety in the present invention includes a formyl group or moiety and an aliphatic- and aromatic acyl groups or moieties), a carbamoyl group (preferably having from 1 to 20, more preferably from 1 to 10 carbon atoms, e.g., N-butylcarbamoyl, N,N-diethylcarbamoyl, N-methylcarbamoyl, N-phenylcarbamoyl, N-mesylcarbamoyl), a sulfamoyl group (preferably having from 0 to 20, more preferably from 0 to 10 carbon atoms, e.g., N-butylsulfamoyl, N,N-diethylsulfamoyl, N-phenylsulfamoyl, N-ethyl-N-phenylsulfamoyl), an alkoxycarbonylamino group (preferably having from 2 to 20, more preferably from 2 to 10 carbon atoms, e.g., ethoxycarbonylamino, butoxycarbonylamino, benzyloxycarbonylamino), a sulfonamido group (including alkyl- and aryl- sulfonamido groups preferably having from 1 to 20, more preferably from 1 to 10 carbon atoms, e.g., methanesulfonamido, ethansulfonamido, butansulfonamido, octanesulfonamido, benzenesulfonamido, p-toluenesulfonamido, 4-methoxybenzenesulfonamido), an alkylthio group (preferably having from 1 to 20, more preferably from 1 to 10 carbon atoms, e.g., methylthio, ethylthio, butylthio, hexylthio), an arylthio group (preferably having from 6 to 20, more preferably from 6 to 10 carbon atoms, e.g., phenylthio, naphthylthio, 4-methoxyphenylthio, 2-pivaloylaminophenylthio, 2-ethoxycarbonylphenylthio, 2-ethoxycarbonylaminophenylthio, 2-benzyloxycarbonylaminophenylthio, 2-diethylaminophenylthio), an aryloxycarbonylamino group (preferably having from 7 to 11 carbon atoms, phenoxycarbonylamino), an alkylcarbonyloxy group (preferably having from 2 to 20, more preferably from 2 to 10 carbon atoms, e.g., acetyloxy, propyonyloxy, pentanoyloxy, hexanoyloxy, cyclohexanoyloxy, 2-ethylhexanoyloxy, pivaloyloxy), an arylcarbonyloxy group (preferably having from 7 to 20, more preferably from 7 to 12 carbon atoms, e.g., benzoyloxy, 2-chlorobenzoyloxy, 2-methoxybenzoyloxy), an ureido group (preferably having from 1 to 20, more preferably from 1 to 10 carbon atoms, e.g., N-phenylureido, N,N-diethylureido), a heterocyclic group (preferably in the form of a 3-membered to 12-membered, more preferably 5-membered or 6-membered, mono-cyclic or condensed ring (e.g., with a benzene ring) preferably having from 1 to 12 carbon atoms and having at least one of hetero atoms chosen from among nitrogen, oxygen and sulfur atoms; e.g., 2-pyridyl, 1-pyrrolyl, morpholino, indolyl), an acyl group (preferably having from 1 to 20, more preferably from 2 to 10 carbon atoms, e.g., acetyl, benzoyl, pivaloyl), a sulfonyl group such as an alkylsulfonyl group (preferably having from 1 to 12, more preferably from 1 to 8 carbon atoms, e.g., methylsulfonyl, butylsulfonyl) and an arylsulfonyl group (preferably having from 6 to 11 carbon atoms, e.g., phenylsulfonyl, tolylsulfonyl), and an imido group (preferably having from 4 to 20, more preferably from 4 to 10 carbon atoms, e.g., succinimido, phthalimido). These groups may optionally be substituted by one or more substituents. As examples of such substituents, those mentioned hereinabove are referred to. In formula (II) f represents 0 or an integer of from 1 to 5. When f is 2 or more, then the plural substituents G's may be the same or different.

Examples of Q represented by the above-mentioned formula (II) include the groups of the following general formulae (Q-1), (Q-2), (Q-3), (Q-4), (Q-5), (Q-6), (Q-7), (Q-8), (Q-9), (Q-10), (Q-11), (Q-12), and (Q-13):

(Q-1)

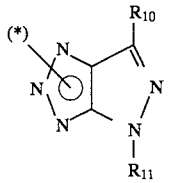

(Q-2)

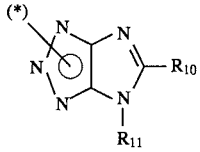

(Q-3)

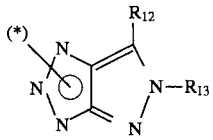

(Q-4)

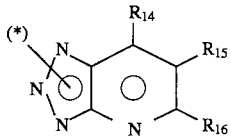

(Q-5)

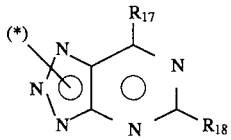

(Q-6)

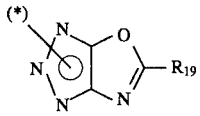

(Q-7)

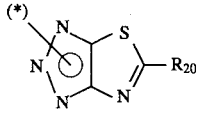

(Q-8)

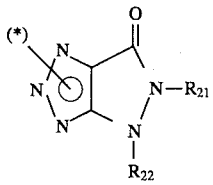

-continued (Q-9)

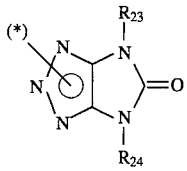

(Q-10)

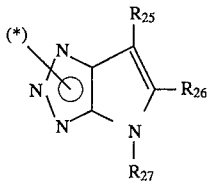

(Q-11)

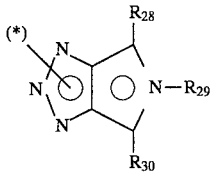

(Q-12)

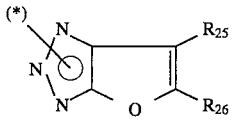

(Q-13)

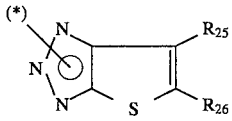

In these formulae, $R_{10}$ to $R_{30}$ each represent a hydrogen atom or have the same meanings as those of the above-mentioned substituent G. (*) indicates the position at which the group bonds to A-(TIME)$_m$-(RED)$_n$-. The group A-(TIME)$_m$-(RED)$_n$- may bond to Q at any nitrogen atom in its 1,2,3-triazole ring.

Preferably, Q is a condensed group of any of formulae (Q-1) to (Q-3) and (Q-6) to (Q-11), which is composed of two 5-membered rings. Especially preferably, it is a condensed group of any of formulae (Q-1) to (Q-3).

In formula (I), m is 0, 1 or 2, and n is 0 or 1. When m is 2, then two TIME's may be the same or different.

Where compounds of formula (II) are more hydrophilic, these are useful as split-off groups for 2-equivalent couplers. In this case, preferably, m and n are both 0 (zero), and A is the above-mentioned non-diffusive yellow coupler residue, magenta coupler residue or cyan coupler residue. In particular, they are suitable for couplers having a high dissociation constant.

Specific examples of compounds represented by formula (I) are shown below, which, however, are not limitative.

(D-1)
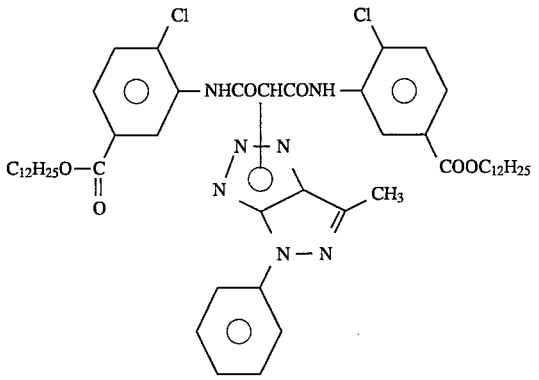
(D-2)
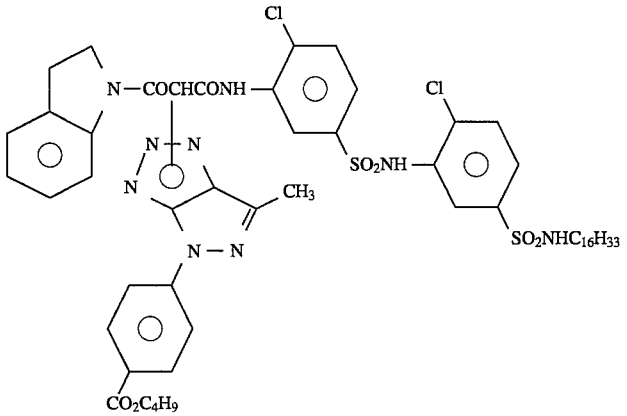
(D-3)
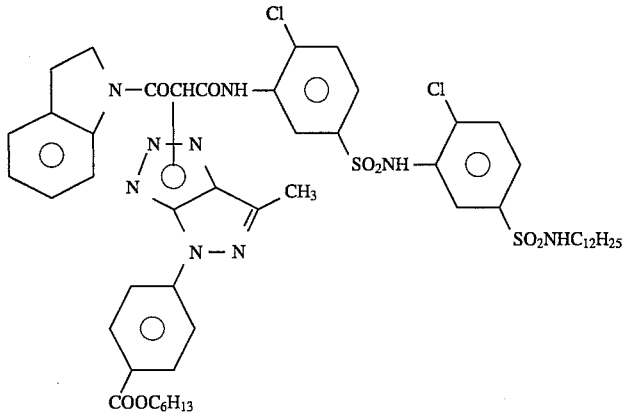
(D-4)
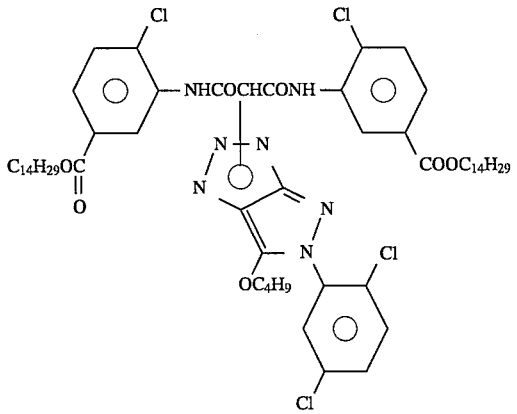

-continued
(D-5)
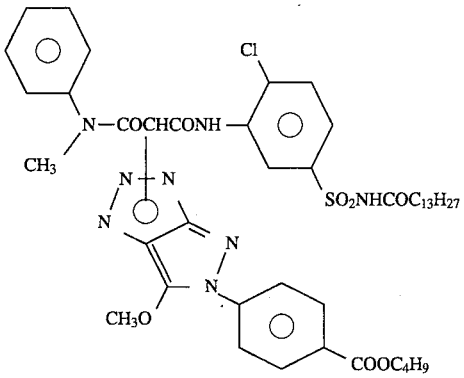
(D-6)
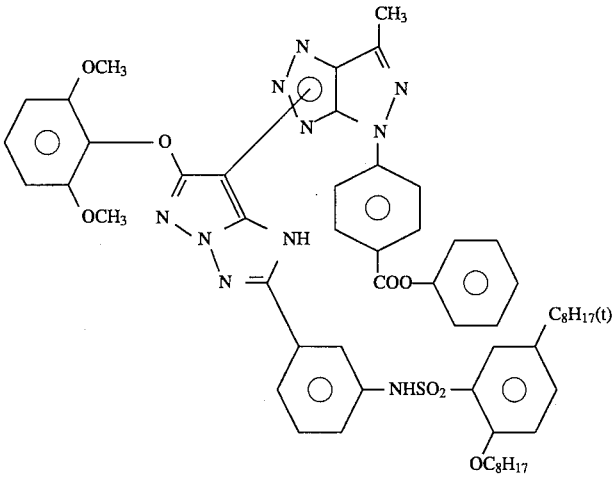
(D-7)
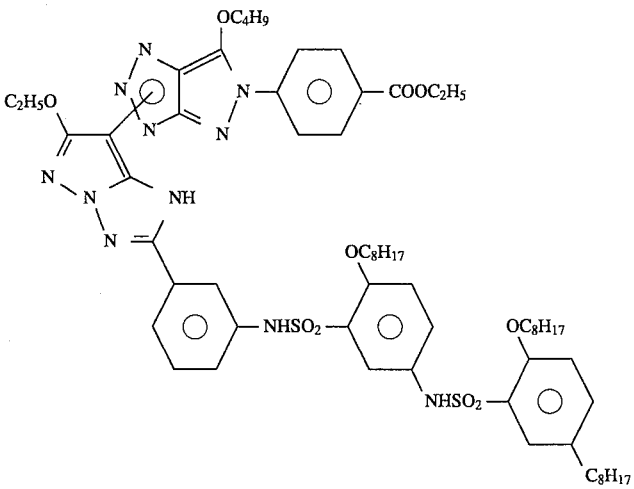

-continued
(D-8)
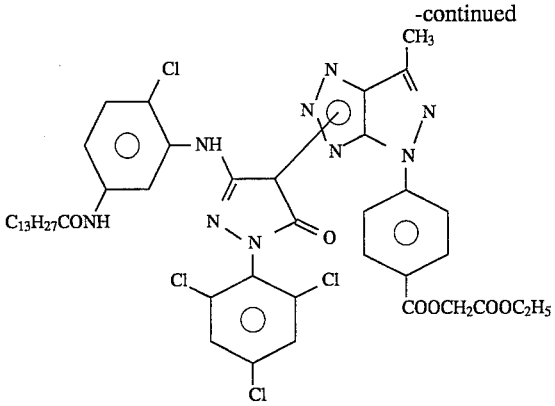
(D-9)
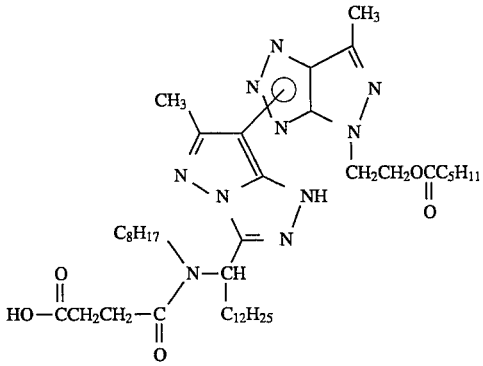
(D-10)
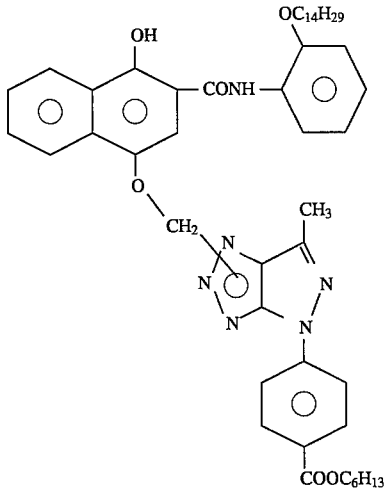
(D-11)
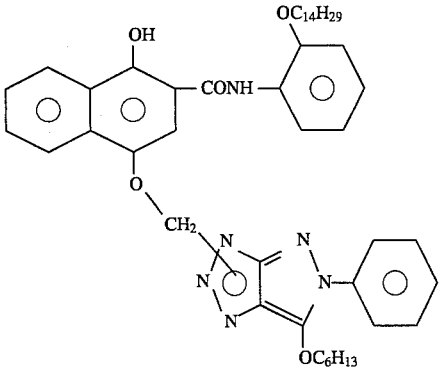

-continued
(D-12)
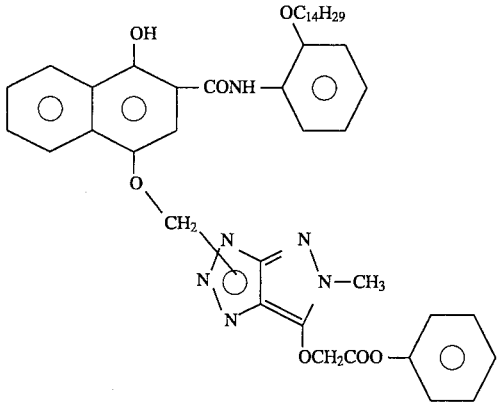
(D-13)
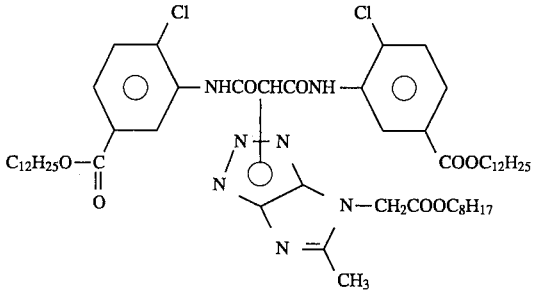
(D-14)
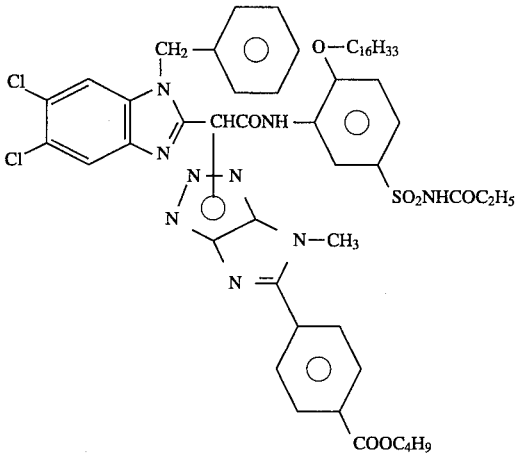
(D-15)
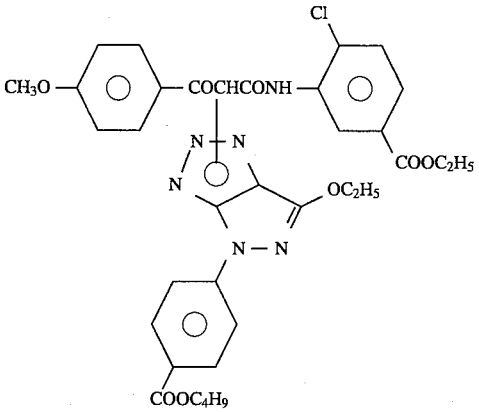

-continued
(D-16)
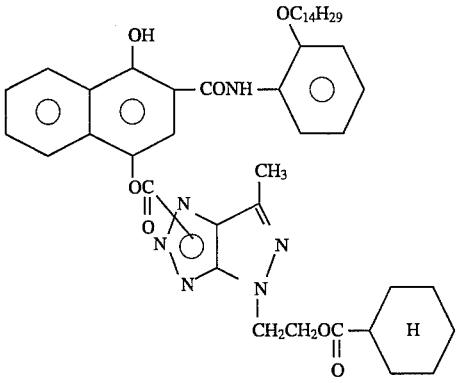
(D-17)
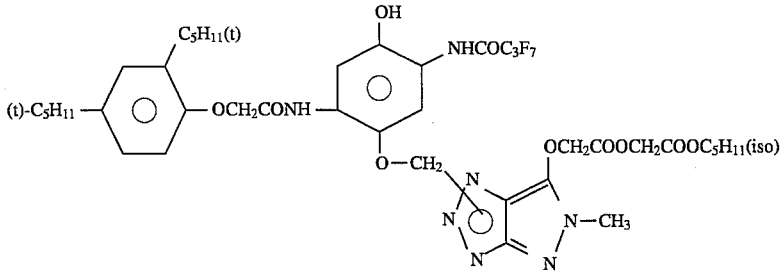
(D-18)
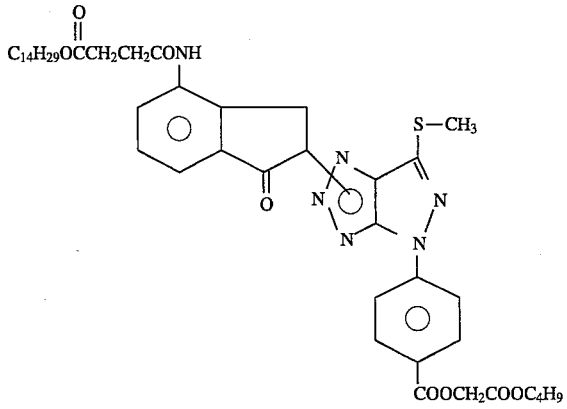
(D-19)
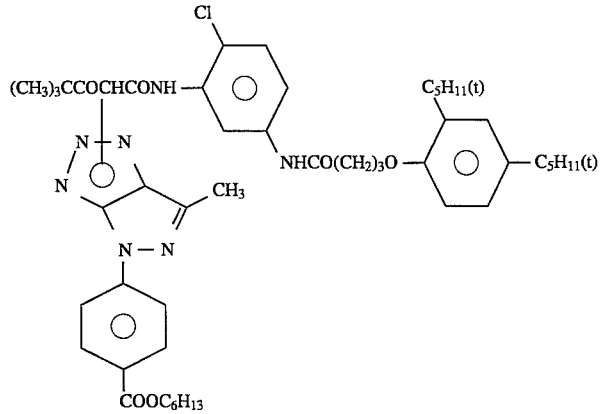

-continued
(D-20)
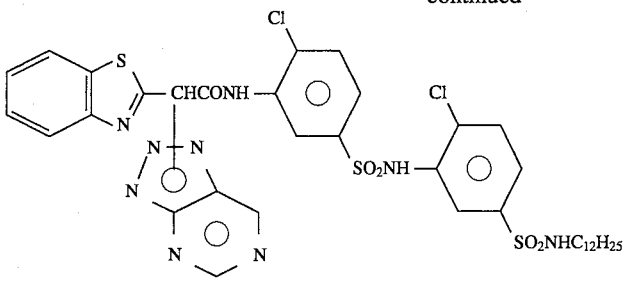
(D-21)
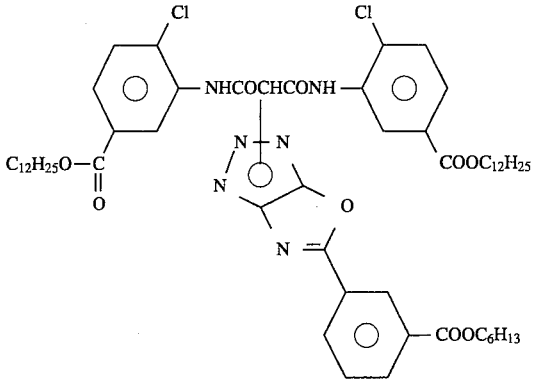
(D-22)
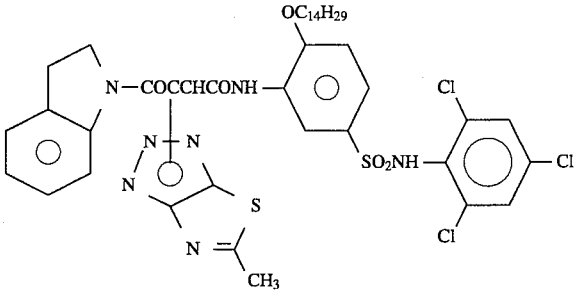
(D-23)
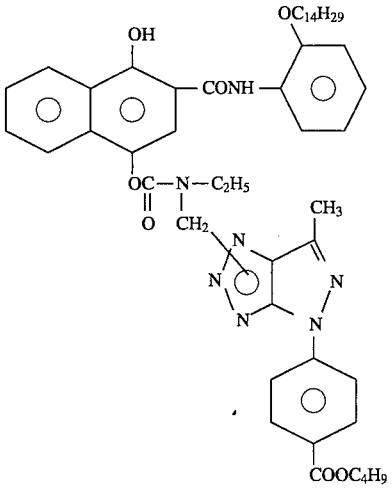

-continued
(D-24)
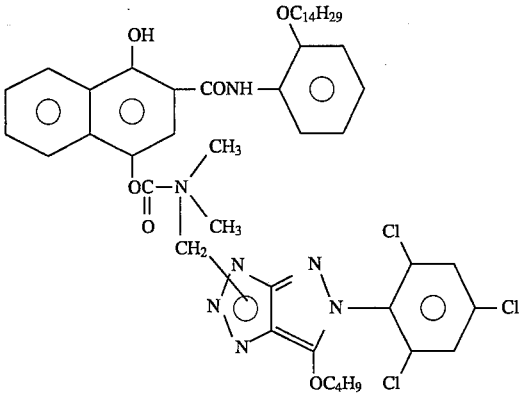
(D-25)
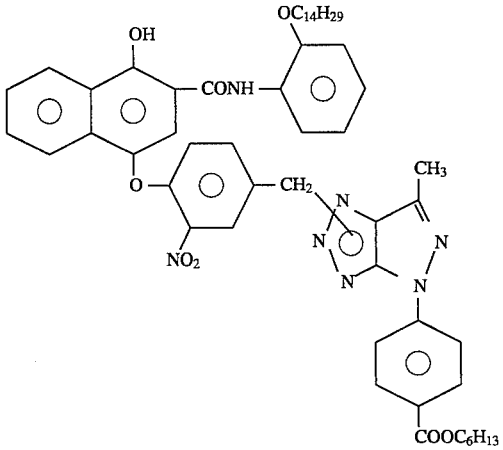
(D-26)
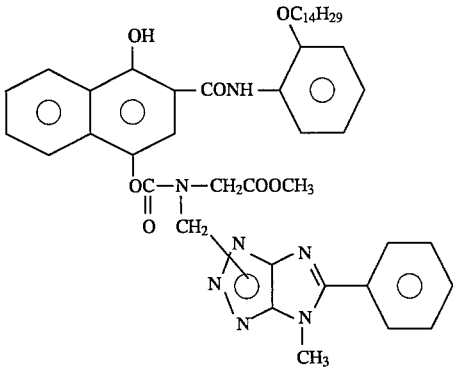

-continued
(D-27)
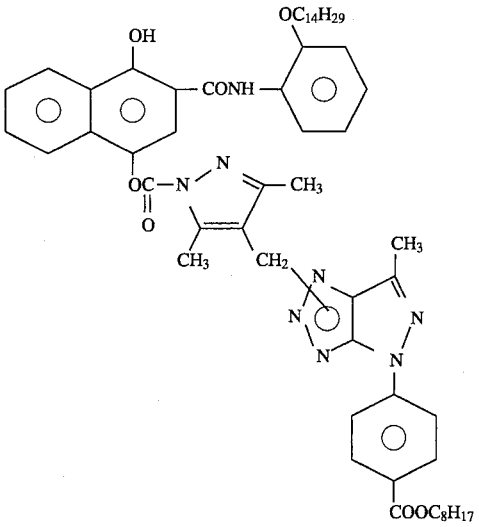
(D-28)
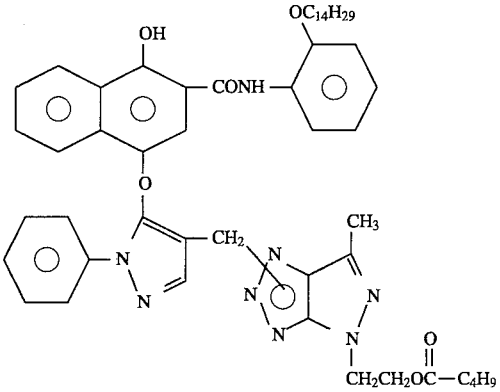
(D-29)
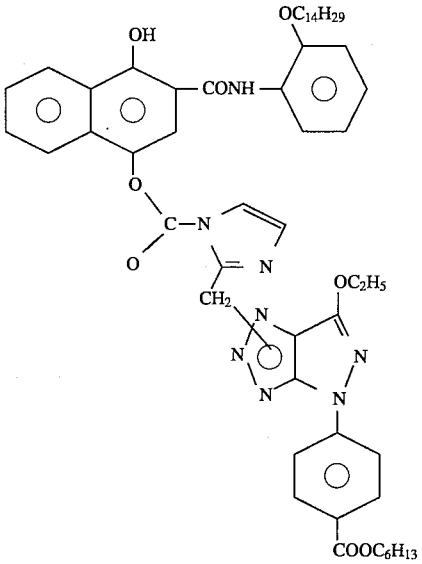

-continued
(D-30)
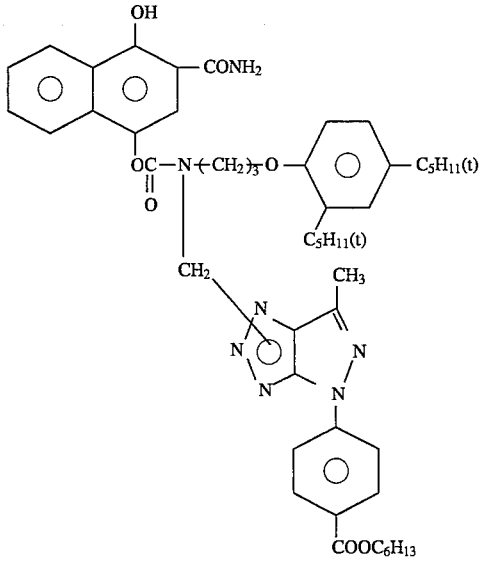
(D-31)
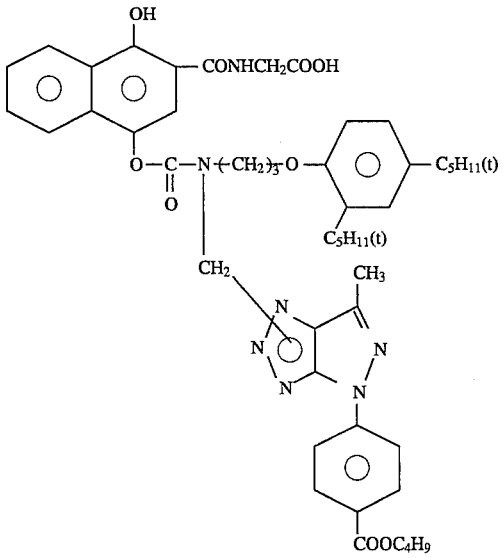
(D-32)
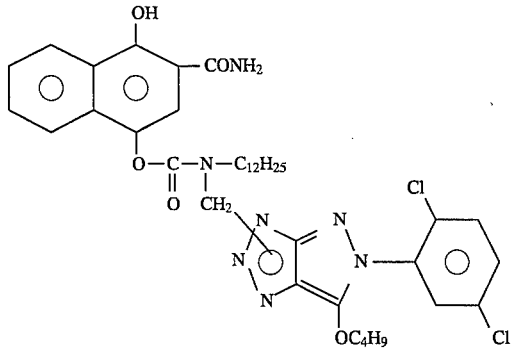

-continued
(D-33)
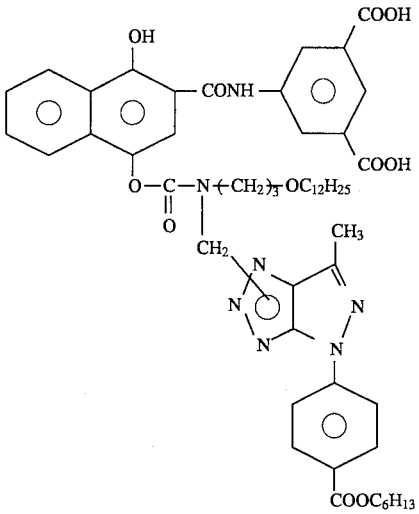
(D-34)
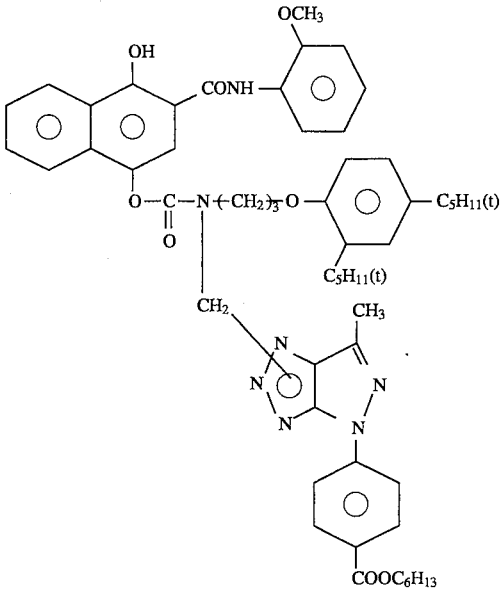
(D-35)
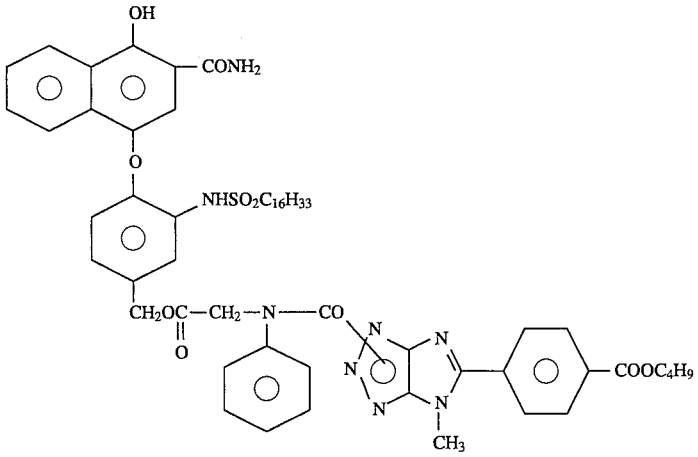

-continued
(D-36)
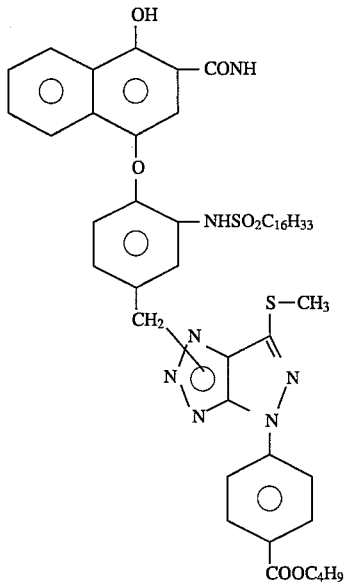
(D-37)
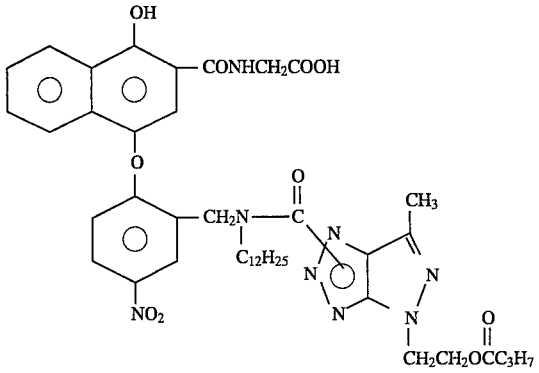
(D-38)
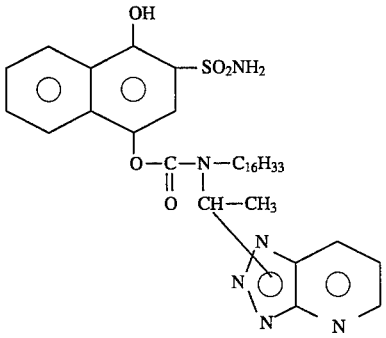
(D-39)
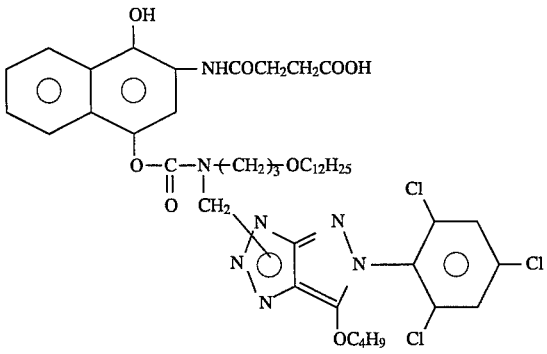

-continued
(D-40)
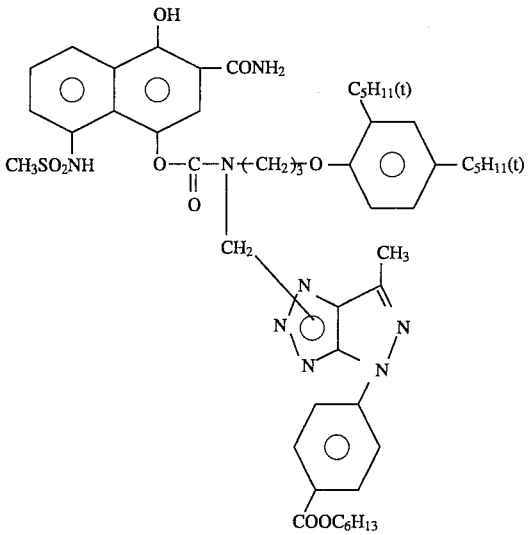
(D-41)
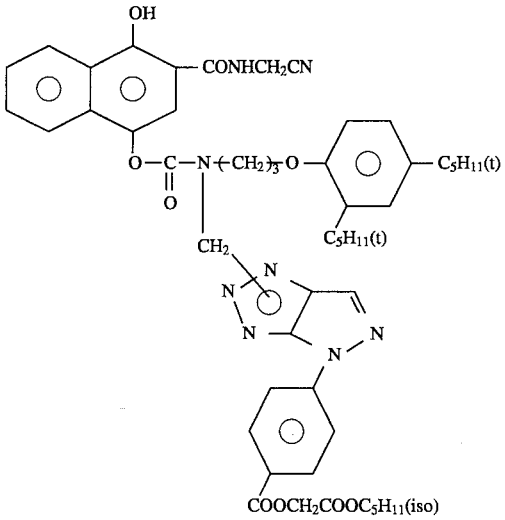
(D-42)
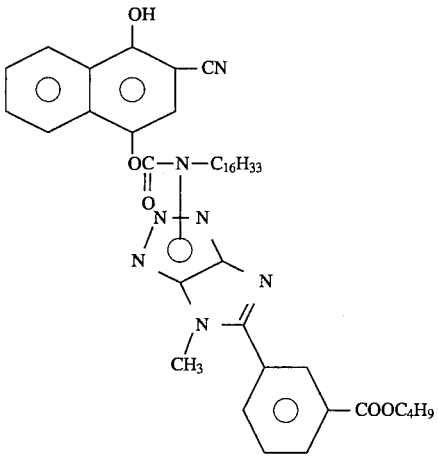

-continued
(D-43)
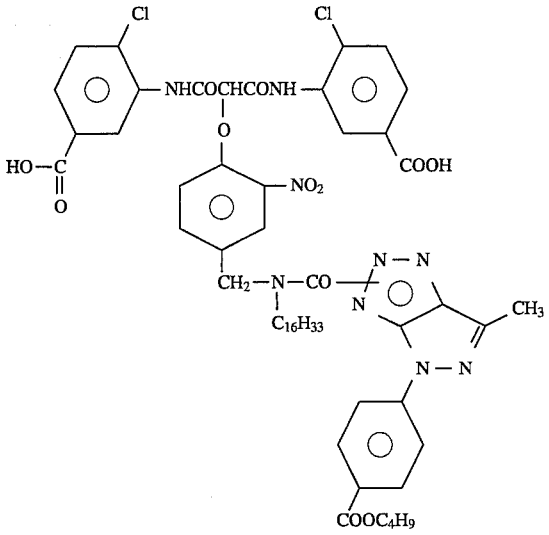
(D-44)
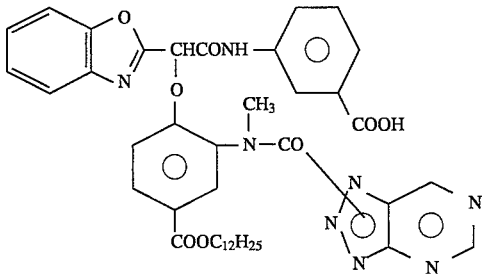
(D-45)
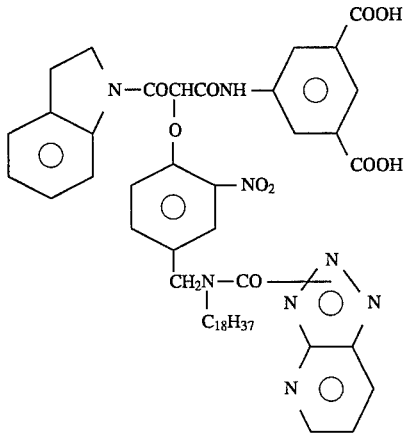
(D-46)
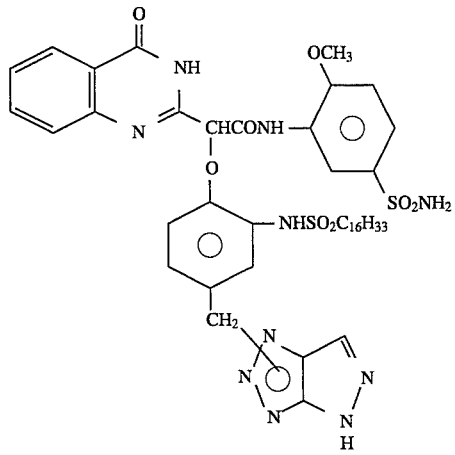

-continued
(D-47)
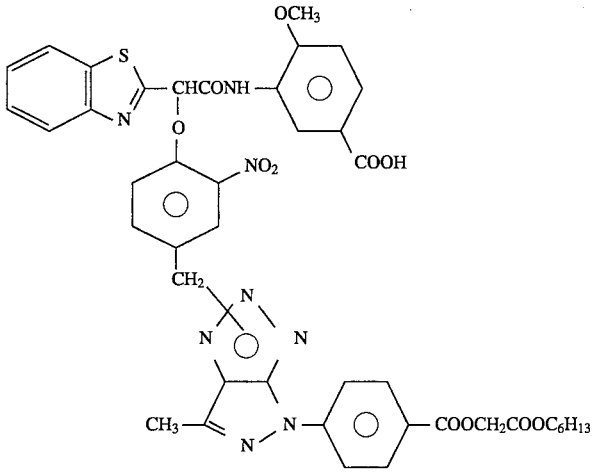
(D-48)
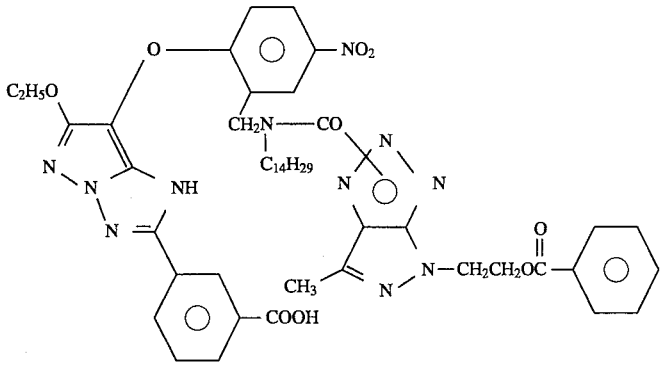
(D-49)
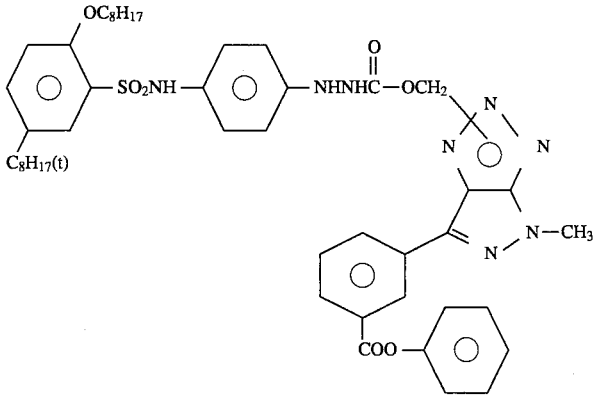
(D-50)
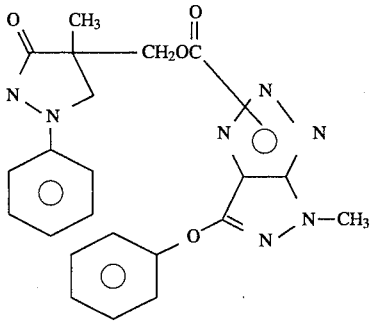

-continued
(D-51)
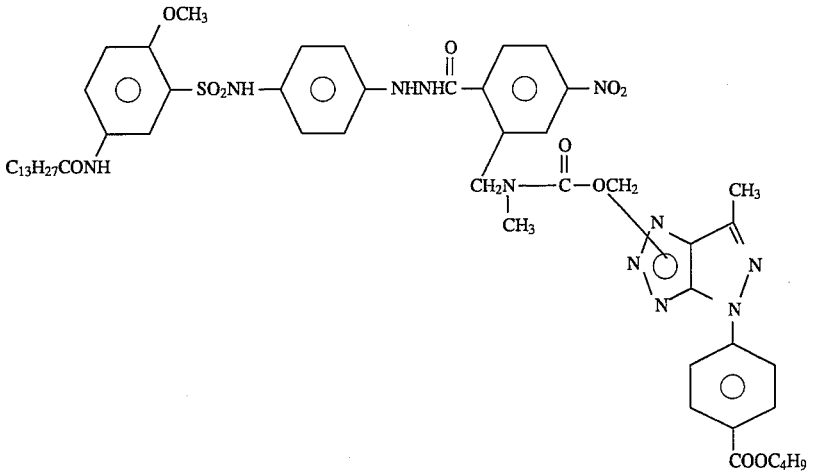
(D-52)
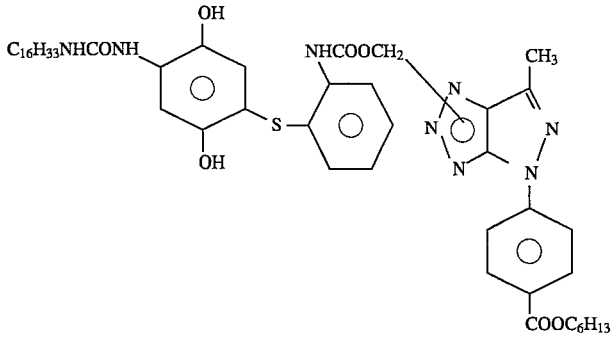
(D-53)
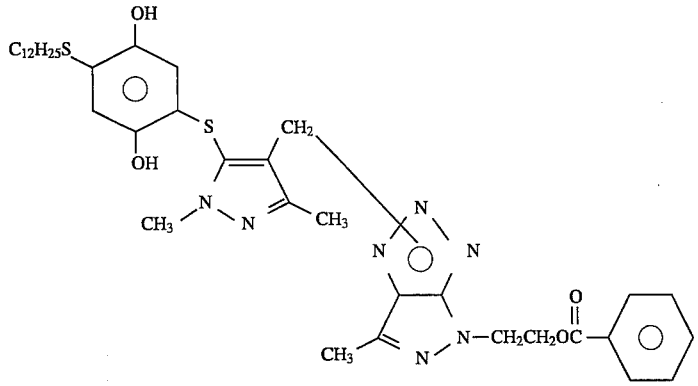
(D-54)
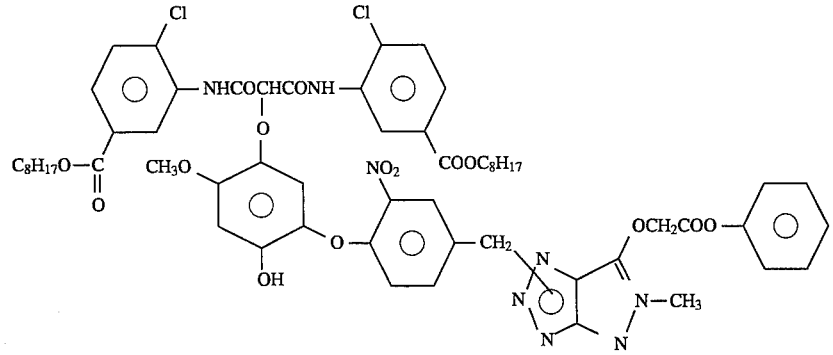

-continued
(D-55)
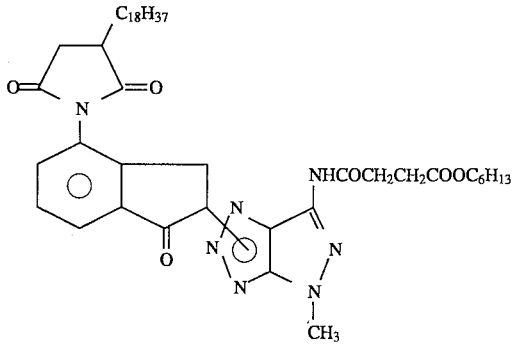
(D-56)
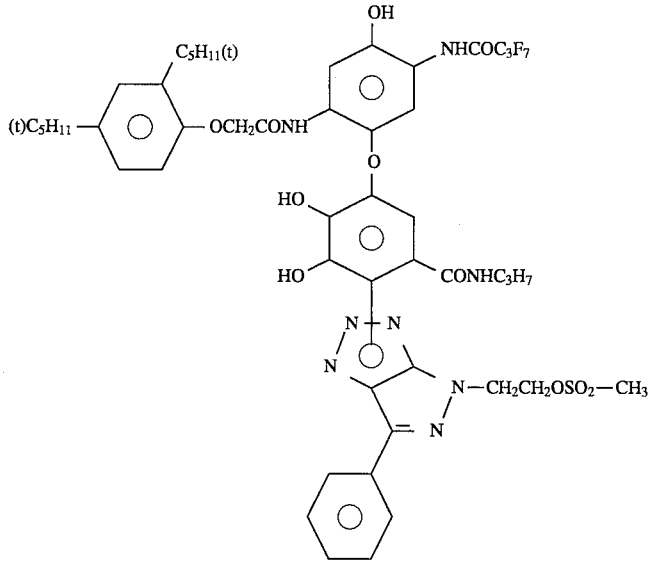
(D-57)
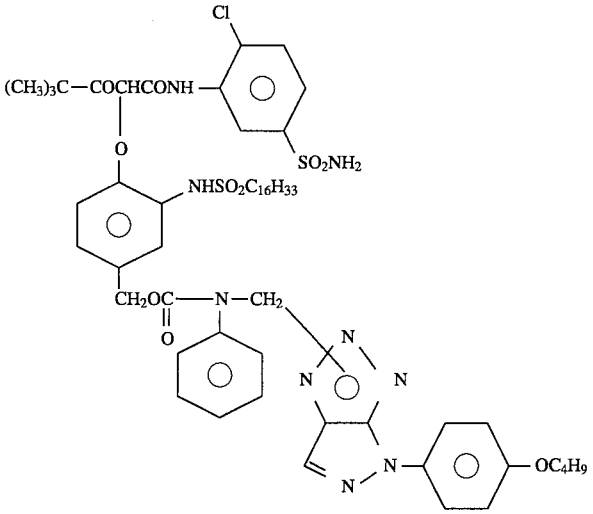

-continued
(D-58)
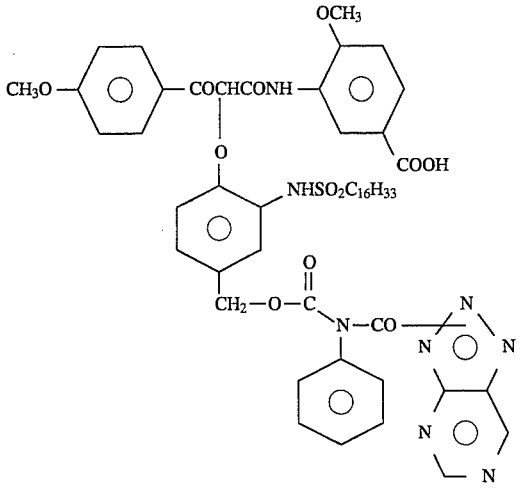
(D-59)
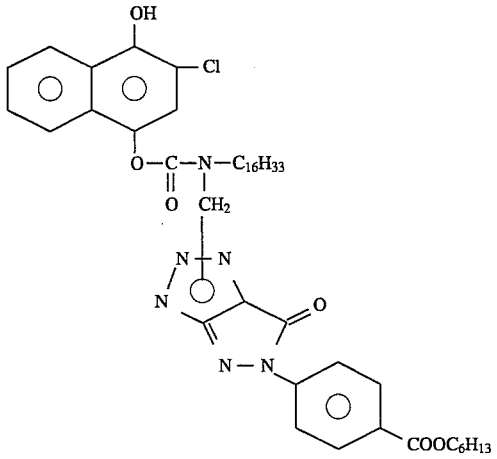
(D-60)
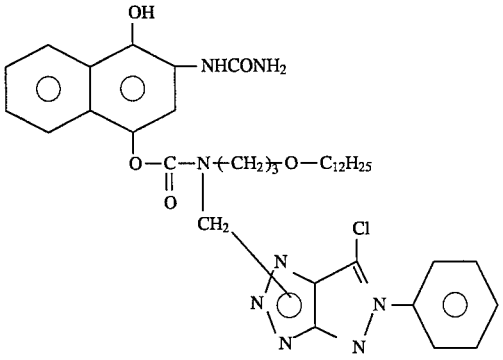

-continued
(D-61)
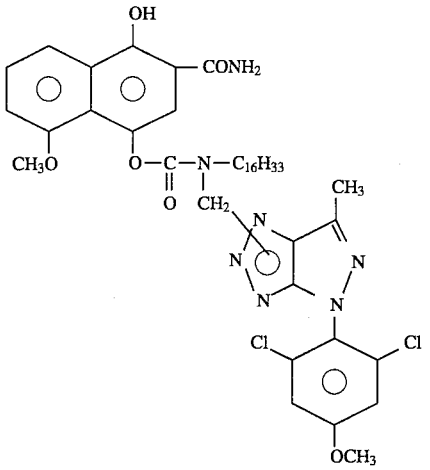
(D-62)
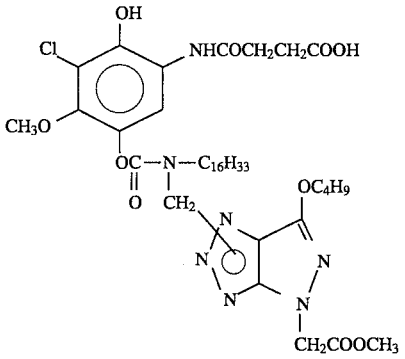
(D-63)
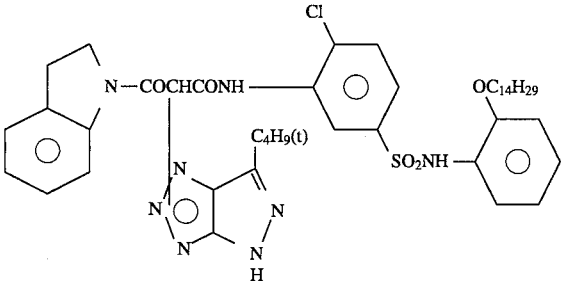
(D-64)
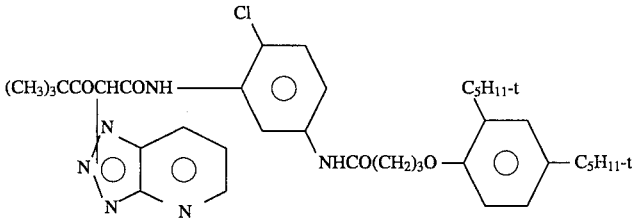

-continued
(D-65)
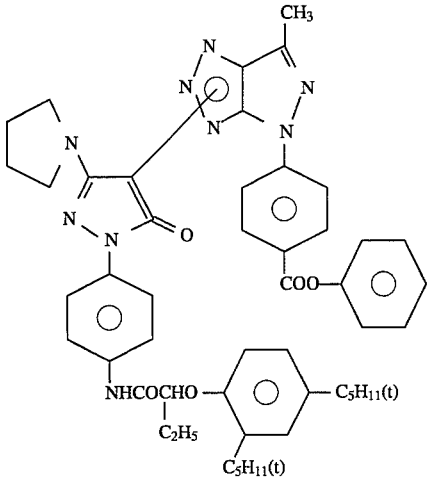
(D-66)
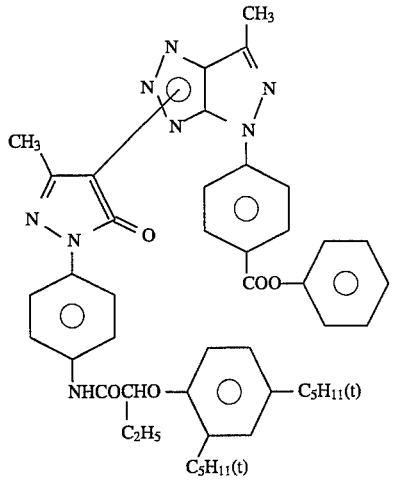
(D-67)
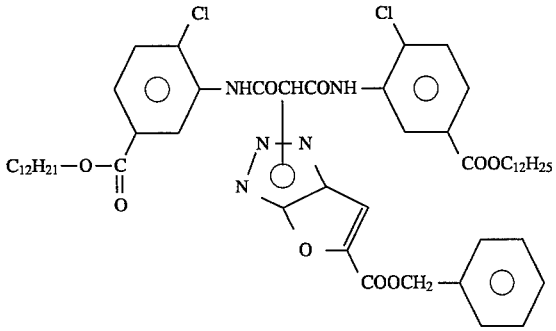
(D-68)
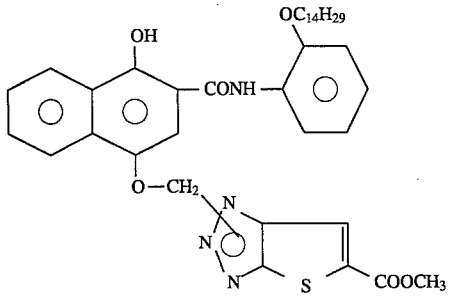
General methods for producing the couplers for use in the present invention are mentioned below.
These couplers for use in the present invention may be produced according to known methods, for example the methods described in JP-A 54-145135, 63-37346, 56-114946, 57-154234, 58-162949, 63-37350, 57-151944, 58-205150, 60-218645, U.S. Pat. Nos. 4,618,571, and 4,770,982, JP-A 63-284159, 60-203943 and 63-23152.

Some specific examples of producing them will be mentioned below.

PRODUCTION EXAMPLE 1 (Production of Coupler D-1)

Reaction Scheme (A)

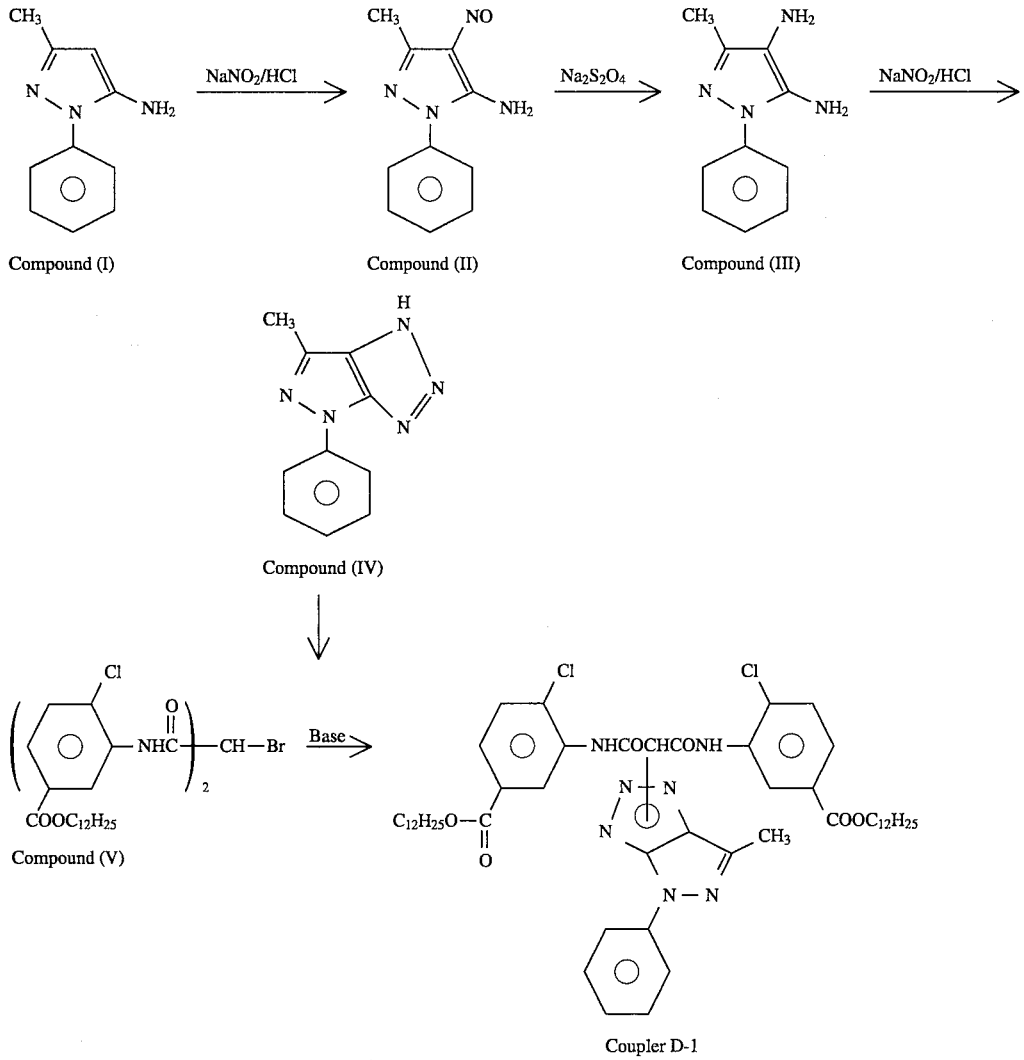

Production of Compound (II):

129 ml of concentrated hydrochloric acid and 250 ml of water were added to 86.6 g of aminopyrazole compound (Compound (I)), cooled to 0° C. and stirred. A solution of 38 g of sodium nitrite dissolved in 80 ml of water was dropwise added to the resulting solution. After the addition, the solution was stirred for 2 hours at 5 to 10° C. After completion of the reaction, 1000 ml of water were added to the reaction mixture, which was then neutralized with sodium hydrogencarbonate. The crystals thus precipitated were taken out by filtration, washed with water and then with 500 ml of acetonitrile, and dried. Thus, 71.0 g (70.2%) of the nitroso compound (Compound (II)) was obtained.

The physical data of the compound obtained were as follows:

Proton NMR, (ppm) (multiplicity, integrated values) (DMSO-d6): 8.48 to 8.23 (br, 2H), 7.75 to 7.35 (m, 5H), 2.67 (s, 3H)

Production of Compound (III):

500 ml of water and 100 ml of methanol were added to 40.4 g of the nitroso compound (Compound (II)) obtained in the previous step and stirred under heat. 80 g of sodium hydrosulfite were added to the resulting solution little by little. After the addition, the solution was stirred under heat for one hour. After completion of the reaction, the solution was cooled to room temperature and then extracted with ethyl acetate. The ethyl acetate solution was washed with water and dried with magnesium sulfate, and the ethyl acetate was removed therefrom by distillation. The residue was recrystallized from a mixed solvent comprising chloroform and hexane. Thus, 21.7 g of the diamino compound (Compound (III)) was obtained. The yield was 57.7%.

The physical data of the compound thus obtained were as follows:

Proton NMR, (ppm) (multiplicity, integrated values) ($CDCl_3$): 7.62 to 7.12 (m, 5H), 4.05 to 1.95 (br, 4H), 2.22 (s, 3H)

Production of Compound (IV):

25.7 g of concentrated hydrochloric acid and 150 ml of water were added to 18.8 g of the diamino compound (Compound (III)) obtained in the previous step, cooled to 5° to 10° C. and stirred. To the resulting solution, a solution of 7.6 g of sodium nitrite dissolved in 20 ml of water was added dropwise. After the addition, the solution was stirred for one hour. After completion of the reaction, the reaction mixture was neutralized with sodium hydrogencarbonate added thereto little by little. Then, the reaction mixture was extracted with ethyl acetate. The ethyl acetate solution was washed with water, and the ethyl acetate was removed therefrom by distillation under reduced pressure. The residue was recrystallized from acetonitrile. Thus, 14.3 g of the triazole compound (Compound (IV)) was obtained. The yield was 71.9%.

The physical data of the compound obtained were as follows:

Proton NMR, (ppm) (multiplicity, integrated values) (DMSO-d6): 12.5 to 12.15 (br, 1H), 8.07 to 7.80 (m, 2H), 7.65 to 7.43 (m, 2H), 7.31 to 7.12 (m, 1H), 2.55 (s, 3H).

Production of Coupler D-1:

200 ml of dimethylacetamide were added to 39.8 g of the triazole compound (Compound (IV)) obtained in the previous step and 27.9 ml of triethylamine, and stirred at room temperature. A solution of 74.8 g of malonic acid dianilide bromide (Compound (V)) dissolved in 200 ml of chloroform was added dropwise to the resulting solution. After the addition, the solution was stirred for 3 hours at room temperature. After completion of the reaction, the solution was extracted with ethyl acetate. The ethyl acetate solution was washed with water, and then the ethyl acetate was removed by distillation under reduced pressure. The residue was separated by silica gel column chromatography to obtain 71.4 g of the intended coupler as a mixture composed of 1-, 2- and 3-substitution products. The yield was 78.4%.

The physical data of the compound obtained were as follows:

Proton NMR, (ppm) (multiplicity, integrated values) ($CDCl_3$): 10.15 (s, 2H), 8.60 (d, 2H), 7.77 (d, 2H), 7.59 (dd, 1H), 7.38 to 7.17 (m, 4H), 7.0 (dd, 1H), 6.78 (s, 1H), 4.05 (t, 4H), 2.43 (s, 3H), 1.65 to 1.40 (m, 4H), 1.30 to 0.90 (br, 36H), 0.66 (t, 6H)

PRODUCTION EXAMPLE 2 (Production of Coupler D-34) Reaction Scheme (B)

Reaction Scheme (B)

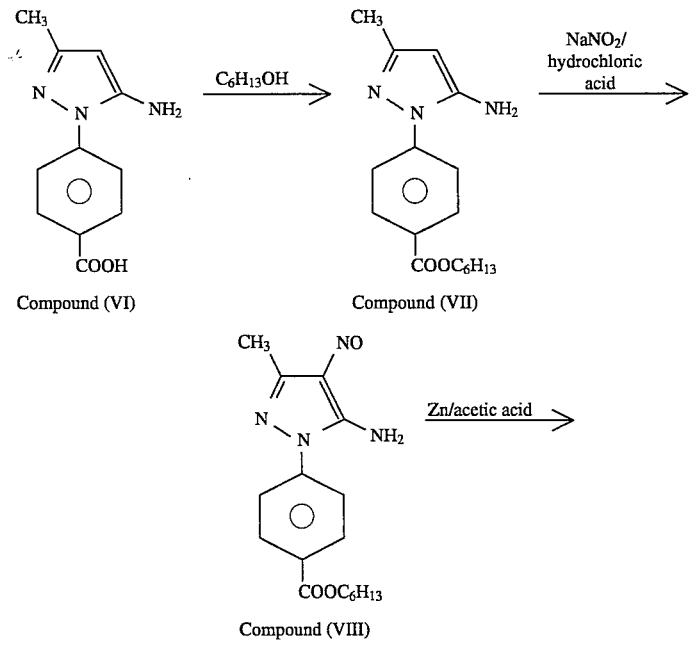

-continued

Reaction Scheme (B)

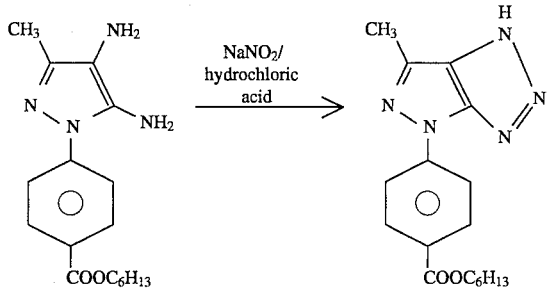

Compound (IX) Compound (X)

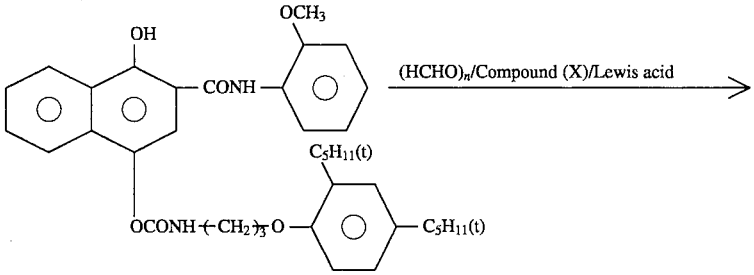

Compound (XI)

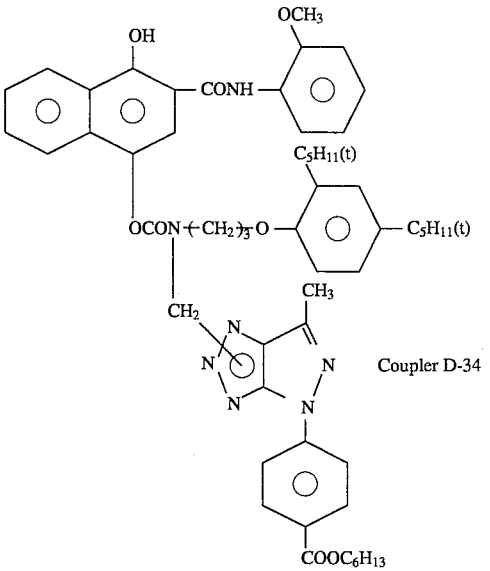

Production of Compound (VII):

38.8 g of hexanol and 350 ml of toluene were added to 55.0 g of aminopyrazole compound (Compound (VI)) and stirred under heat. To the resulting solution, 48.6 g of methanesulfonic acid was dropwise added. After the addition, the solution was stirred under heat for 4 hours, and then the toluene was removed therefrom by distillation under reduced pressure. Water was added to the residue, which was then neutralized with sodium hydrogencarbonate and extracted with ethyl acetate. The ethyl acetate solution was washed with water, and the ethyl acetate was removed therefrom by distillation under reduced pressure. 250 ml of methanol and 100 ml of water were added to the residue, from which crystals precipitated. The crystals were taken out by filtration to obtain 55.8 g of the ester (Compound (VII)). The yield was 73.2%.

Production of Compound (VIII):

36 ml of concentrated hydrochloric acid and 200 ml of methanol were added to 42.2 g of the ester (Compound (VII)) obtained in the previous step, cooled to 0° C. and stirred. To the resulting solution, a solution of 10.1 g of sodium nitrite dissolved in 50 ml of water was added dropwise. After the addition, the solution was stirred for one hour, and thereafter an aqueous solution of sodium hydrogencarbonate was added thereto to neutralize the reaction mixture. The crystals thus precipitated were taken out by filtration, washed with water and dried. Thus, 42.7 g of the nitroso compound (Compound (VIII)) was obtained. The yield was 92.3%.

Production of Compound (IX):

350 ml of methanol and 50 ml of water were added to 33.0 g of the nitroso compound (Compound (VIII) obtained in the previous step and 50 g of zinc powder, and stirred under heat. To the resulting solution, 50 ml of acetic acid was added dropwise and stirred under heat for one hour. After completion of the reaction, the solution was cooled to room temperature and extracted with ethyl acetate. The ethyl acetate solution was washed with water, and the ethyl acetate was removed therefrom by distillation under reduced pressure to obtain the diamine compound (Compound (IX)). This was used directly in the next reaction as it was.

Production of Compound (X):

150 ml of methanol and 25 ml of concentrated hydrochloric acid were added to the diamine compound (Compound (IX)) obtained in the previous step, cooled to 0° C. and stirred. To the resulting solution, a solution of 7.6 g of sodium nitrite dissolved in 25 ml of water was added dropwise. After reacted for one hour, the reaction mixture was neutralized with an aqueous solution of sodium hydrogencarbonate. The reaction mixture was extracted with ethyl acetate added thereto, the ethyl acetate solution was washed with water, and the ethyl acetate was removed therefrom by distillation under reduced pressure. Acetonitrile was added to the residue to precipitate crystals therefrom, and these were taken out by filtration. Thus, 23.4 g of the triazole compound (Compound (X)) was obtained. The yield was 71.5%.

The physical properties of the compound obtained were as follows:

Proton NMR, (ppm) (multiplicity, integrated values) ($CDCl_3$): 12.52 (brs, 1H), 8.23 (d, 2H), 8.06 (d, 2H), 4,35 (t, 2H), 2.62 (s, 3H), 1.90 to 1.65 (m, 2H), 1.58 to 1.18 (m, 6H), 0.92 (t, 3H)

Production of Coupler D-34:

200 ml of toluene were added to 30.3 g of naphthol coupler (Compound (XI)), 1.65 g of paraformaldehyde and 13.3 g of the triazole compound obtained in the previous step, and stirred under heat at 45° C. To the resulting solution, 5.58 g of cupric bromide was added and stirred under heat for 9 hours. Next, 1.30 g of the triazole compound, 0.17 g of paraformaldehyde and 2.79 g of cupric bromide were added thereto and stirred for 2 hours. After the reaction, the reaction mixture was extracted with ethyl acetate, and the ethyl acetate solution was washed with an aqueous diluted hydrochloric acid. This was washed with water, and the ethyl acetate was removed therefrom by distillation under reduced pressure. The residue was purified by silica gel column chromatography to obtain 22.3 g of Coupler D-34. The yield was 51.8%.

The physical properties of the compound obtained were as follows:

Proton NMR, (ppm) (multiplicity, integrated values) ($CDCl_3$): 13.65 (s, 1H), 8.67 to 8.33 (m, 3H), 8.25 to 7.95 (m, 5H), 7.65 to 6.33 (m, 9H), 6.45 to 6.22 (br, 2H), 4.33 (t, 2H), 4.20 to 3.95 (br, 2H), 3.94 to 3.80 (br, 5H), 2.63 (s, 3H), 1.98 to 1.20 (m, 26H), 0.90 (t, 3H), 0.75 to 0.50 (m, 6H)

The compound represented by formula (I) may be incorporated into any layer constituting the photographic material but are preferably incorporated into at least one of the light-sensitive silver halide emulsion layer(s) and the layer(s) adjacent to the light-sensitive silver halide emulsion layer(s). The compound is especially preferably incorporated into at least one of the light-sensitive silver halide emulsion layer(s). The total amount of the at least one compound selected from the compounds of formula (I) incorporated into the photographic material is preferably from $3\times10^{-7}$ to $1\times10^{-3}$ mol/m$^2$, more preferably from $3\times10^{-6}$ to $7\times10^{-4}$ mol/m$^2$, especially preferably from $1\times10^{-5}$ to $4\times10^{-4}$ mol/m$^2$.

The layer other than the light-sensitive layer, to which the compound of formula (I) is incorporated may be any hydrophilic colloid layer coated on the support, such as, an interlayer, an untihalation layer and irradiation preventing layer.

The photographic material of the present invention is not specifically defined, provided that it has at least one light-sensitive layer on a support. As one typical example, there is mentioned a silver halide photographic material having on a support at least one light-sensitive layer composed of plural silver halide emulsion layers each having substantially the same color-sensitivity but having a different sensitivity degree. The light-sensitive layer is a unit light-sensitive layer having a color-sensitivity to anyone of blue light, green light and red light. In a multi-layer silver halide color photographic material, in general, the order of the light-sensitive layer units comprises a red-sensitive layer unit, a green-sensitive layer unit and a blue-sensitive layer unit formed on the support in this order. As the case may be, however, the order may be opposite to the above-mentioned one, depending on the object of the photographic material. As still another embodiment, a different color-sensitive layer may be sandwiched between other two and the same color-sensitive layers. Light-insensitive layers may be provided between the above-mentioned silver halide light-sensitive layers or may be provided as an uppermost layer and/or a lowermost layer. These layers may contain couplers, DIR compounds, color mixing preventing agents and others which will be mentioned hereunder. As described in DE 1,121,470 and GB 923,045, the plural silver halide emulsion layers constituting a respective light-sensitive layer unit, preferably is a two-layered constitution composed of a high-sensitivity emulsion layer and a low-sensitivity emulsion layer arranged on the support in such a way that the sensitivity degree of the layer is to gradually decrease in the direction to the support. As another embodiment, a low-sensitivity emulsion layer is formed remote from the support while a high-sensitivity emulsion layer is formed near to the support, as described in JP-A 57-112751, 62-200350, 62-206541, and 62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B 55-34932; and an order of blue-sensitive layer/GL/RL/GH/RH from the remotest side from the support, as described in JP-A 56-25738 and 62-63936.

As further example, there is a three-layer unit constitution as described in JP-B 49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity degree of each emulsion layer is gradually lowered to the direction of the support. Even in such a three-layer constitution having the same color-sensitivity, the layers may be composed of middle-sensitivity emulsion layer/high-sensitivity emulsion layer/low-sensitivity emulsion layer formed in this order from the remotest side from the support, as described in JP-A 59-202464.

As still other examples of the layer constitution of the photographic material of the present invention, there are mentioned an order of high-sensitivity emulsion layer/low-sensitivity emulsion layer/middle-sensitivity emulsion layer/, and an order of low-sensitivity emulsion layer/ middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is desired to provide a doner layer (CL) which has an interlayer effect and which has a color sensitivity distribution different from that of the essential light-sensitive layers of BL, GL and RL, adjacent to or near to the essential light-sensitive layers, in the manner as described in U.S. Pat. Nos. 4,663,277, 4,705, 744 and 4,707,436 and JP-A 62-160448 and 63-89850.

Silver halides preferably used in the present invention are silver iodobromides, silver iodochlorides or silver iodochlorobromides having a silver iodide content of about 30 mol % or less. Especially preferred are silver iodobromides or silver iodochlorobromides having a silver iodide content of from about 2 mol % to about 10 mol %.

The silver halide grains in the photographic emulsion constituting the photographic material of the present invention may be regular crystallines such as cubic, octahedral or tetradecahedral grains, or irregular crystallines such as spherical or tabular grains, or irregular crystallines having a crystal defect such as a twin plane, or composite crystallines composed of the above-mentioned regular and irregular crystalline forms.

Regarding the grain size of the silver halide grains, the grains may be fine grains having a small grain size of about 0.2 microns or less as the diameter of the projected area or may be large ones having a large grain size of up to about 10 microns as the diameter of the projected area. The emulsion of the grains may be either a polydispersed emulsion or a monodispersed emulsion.

The silver halide photographic emulsions to be used in the present invention may be prepared by various methods, for example, those described in Research Disclosure (hereinafter referred to as RD) No. 17643 (December, 1978), pages 22 to 23 (I. Emulsion Preparation and Types); RD No. 18716 (November, 1979), pages 648; RD No. 307105 (November 1989), pages 863 to 865; P. Glafkides, *Chimie et Physique Photographique* (published by Paul Montel, 1967); G. F. Duffin, *Photographic Emulsion Chemistry* (publisher by Focal Press, 1966); and V. L. Zelikman et al, *Making and Coating Photographic Emulsion* (published by Focal Press, 1964).

Monodispersed emulsions as described in U.S. Pat. Nos. 3,574,628 and 3,655,394 and GB 1,413,748 are also preferably used in the present invention.

Additionally, tabular grains having an aspect ratio of about 3 or more may also be used in the present invention. Tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,430, 048 , and 4,439,520, and GB 2,112,157.

Regarding the crystal structure of the silver halide grains, the grains may have the same halogen composition throughout the whole grain, or they may have different halogen compositions between the inside part and the outside part of one grain, or they may have a layered structure. Further, the grains may have different halogen compositions conjugated by epitaxial bond, or they may conjugated with other compounds than silver halides, such as silver rhodanide or lead oxide. Additionally, a mixture of various grains of different crystalline forms may be employed in the present invention.

The above-mentioned emulsions for use in the present invention may be either surface latent image type ones of forming latent images essentially on the surfaces of the grains or internal latent image type ones of forming latent images essentially in the insides of them, or may also be surface/inside latent image type ones of forming a latent images both on the surfaces of the grains and in the insides of them. Anyhow, the emulsions are needed to be negative emulsions. As an internal latent image type emulsion, it may be a core/shell type internal latent image type emulsion as described in JP-A 63-264740. A methods of preparing such emulsions is described in JP-A 59-133542. The thickness of the shell of the emulsion grains of the type varies depending on the way of developing them, and is preferably from 3 to 40 nm, especially preferably from 5 to 20 nm.

The emulsions are generally physically ripened, chemically ripened and/or spectrally-sensitized. Additives to be used in such a ripening or sensitizing step are described in RD Nos. 17643, 18716 and 307105, and the related descriptions in these references are shown in the table mentioned below.

In the photographic material of the present invention, two or mere emulsions which are different from one another in at least one characteristic of light-sensitive silver halide emulsions, such as the grain size, the grain size distribution, the halogen composition, the shape and the sensitivity of the grains, can be incorporated into the same layer.

Surface-fogged silver halide grains as described in U.S. Pat. No. 4,082,553; inside-fogged silver halide grains as described in U.S. Pat. No. 4,626,498 and JP-A 59-214852; as well as colloidal silver may preferably be used into light-sensitive silver halide emulsion layers and/or substantially non-light-sensitive hydrophilic colloid layers. Inside-fogged or surface-fogged silver halide grains are such grains that can be non-imagewise uniformly developed irrespective of the non-exposed area and the exposed area of the photographic material. Method of preparing them are described in U.S. Pat. No. 4,626,498 and JP-A 59-214852. The silver halide of forming the inside nucleus of an inside-fogged core/shell type silver halide grain may have a different halogen composition. The inside-fogged or surface-fogged silver halide may be any of silver chloride, silver chlorobromide, silver iodobromide or silver chloroiodobromide. The mean grain size of such fogged silver halide grains is preferably from 0.01 to 0.75 μm, especially preferably from 0.05 to 0.6 μm. The grains may be regular ones. The emulsion containing them may be either a monodispersed one or a polydispersed one. Preferred is a monodispersed one, in which at least 95% by weight or by number of the silver halide grains therein have a grain size to fall within the range of the mean grain size ±40%.

The photographic material of the present invention preferably contain non-light-sensitive fine silver halide grains. Non-light-sensitive fine silver halide grains are fine silver halide grains which are not sensitive to the light as imparted to the photographic material for imagewise exposure thereof and are substantially not developed in the step of development processing. These fine grains are desired not previously fogged. The fine silver halide grains have a silver bromide content of from 0 to 100 mol % and, if desired, they may additionally contain silver chloride and/or silver iodide. Preferably, they contain silver,iodide in an amount of from 0.5 to 10 mol %. The fine silver halide grains are desired to have a mean grain size (as a mean value of the diameters of the circles corresponding to the projected areas of the grains) of from 0.01 to 0.5 μm, more preferably from 0.02 to 0.2 μm.

The fine silver halide grains may be prepared by the same methods as those of preparing ordinary light-sensitive silver halide grains. The surfaces of the fine silver halide grains do not need to be optically sensitized and spectral sensitization of the grains is unnecessary. However, prior to addition of the fine grains to the coating composition, it is desired to previously add a known stabilizer, such as triazole compounds, azaindene compounds, benzothiazolium compounds, mercapto compounds or zinc compounds, to the coating composition. The fine silver halide grains-containing layer may contain colloidal silver.

The total coated amount of silver (silver in light-sensitive and light-insensitive silver halide and colloidal silver) in the photographic material of the present invention is preferably 6.0 g/m$^2$ or less, most preferably 4.5 g/m$^2$ or less.

Various known photographic additives which may be used in the present invention are mentioned in RD's, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Spectrally Sensitizing Agent Super Sensitizine Agent | pages 23 to 24 | page 648, right column, to page 649, right column | pages 866 to 868 |
| 4 Brightening Agent | page 24 | page 647, right column | page 868 |
| 5 Light Absorbent Filter Dye Ultraviolet Absorbent | pages 25 to 26 | page 649, right column to page 650, left column | page 873 |
| 6 Binder | page 26 | page 651, left column | page 873 to 874 |
| 7 Plasticizer, Lubricant | page 27 | page 650, right column | page 876 |
| 8 Coating Aid Surfactant | pages 26 to 27 | page 650, right column | pages 875 to 876 |
| 9 Antistatic Agent | page 27 | page 650, right column | pages 876 to 877 |
| 10 Mat Agent | | | pages 878 to 879 |

Various color couplers can be incorporated into the photographic material of the present invention. The following couplers are especially preferred.

Yellow Couplers:

Couplers of formulae (I) and (II) in EP 502,424A; couplers of formulae (1) and (2) in EP 513,496A (especially, Y-28 in page 18); couplers of formula (I) stated in claim 1 of JP-A 5-307248; couplers of formula (I) in U.S. Pat. No. 5,066,576, column 1, lines 45 to 55; couplers of formula (I) in column 0008 in JP-A 4-274425; couplers stated in claim 1 of EP 498,381A1, page 40 especially D-35 in page 18; couplers of formula (Y) in EP 447,969A1, page 4 (especially, Y-1 in page 17 and Y-54 in page 41); couplers of formulae (II) to (IV) in U.S. Pat. No. 4,476,219, column 7, lines 36 to 58 (especially, II-17 and 19 in column 17 and II-24 in column 19).

Magenta Couplers:

In JP-A 3-39737, L-57 (page 11, right bottom column), L-68 (page 12, right bottom column), L-77 (page 13, right bottom column); in EP 456,257, [A-4]-63 (page 134), [A-4]-73 and [A-4]-75 (page 139); in EP 486,965, M-4 and M-6 (page 26), M-7 (page 27); in JP-A 6-43611, column 0024, M-45; in JP-A 5-204106, column (0036), M-1; in JP-A 4-362631, column (0237) M-22.

Cyan Couplers:

In JP-A 4-204843, CX-1, 3, 4, 5, 11, 12, 14 and 15 (pages 14 to 16); in JP-A 4-43345, C-7 and C-10 (page 35), C-34 and C-35 (page 37), (I-1) and (I-17) (pages 42 to 43); couplers of formulae (Ia) and (Ib) in claim 1 of JP-A 6-67385.

Polymer Couplers:

P-1 and P-5 in JP-A 2-44345, page 11.

Couplers capable of forming colored dyes with pertinent diffusibility may also be used, and those described in U.S. Pat. No. 4,366,237, GB 2,125,570, EP 96,570, and DE 3,234,533 are preferred.

As couplers for correcting unnecessary absorption of colored dyes, are preferably used yellow colored cyan couplers of formulae (CI), (CII), (CIII) and (CIV) described in EP 456,257A1, page 5 (especially, YC-86 in page 84); yellow colored magenta couplers ExM-7 (page 202), Ex-1 (page 249) and Ex-7 (page 251) in EP 456,257A1; magenta colored cyan couplers CC-9 (column 8) and CC-13 (column 10) in U.S. Pat. No. 4,833,069; (2) (column 8) in U.S. Pat. No. 4,837,136; and colorless masking couplers of formula (A) in claim 1 of WO92/11575 (especially compounds illustrated in pages 36 to 45).

As compounds (including couplers) which release a residue of a photographically-useful compound when reacted with an oxidation product of a developing agent, are mentioned the following:

Development Inhibitor-releasing Compounds:

Compounds of formulae (I), (II), (III) and (IV) described in EP 378,236A1, page 11 (especially, T-101 in page 30, T-104 in page 31, T-113 in page 36, T-131 in page 45, T-144 in page 51, T-158 in page 58); compounds of formula (I) in EP 436,938A2, page 7 (especially, D-49 in page 51); compounds of formula (1) in Japanese Patent Application No. 4-134523 (especially, (23) in column (0027)); compounds of formulae (I), (II) and (III) in EP 440,195A2, pages 5 to 6 (especially, I-(1) in page 29).

Bleaching Accelerator-releasing Compounds:

Compounds of formulae (I) and (I') in EP 310,125A2, page 5 (especially (60) and (61) in page 61); compounds of formula (I) in claim 1 of JP-A 6-59411 (especially, (7) in column (0022)).

Ligand-releasing Compounds:

Compounds of LIG-X in claim 1 of U.S. Pat. No. 4,555,478 (especially compounds in column 12, lines 21 to 41).

Leuco Dye-releasing Compounds:

Compounds 1 to 6 in U.S. Pat. No. 4,749,641, columns 3 to 8.

Fluorescent Dye-releasing Compounds:

Compounds represented by COUP-DYE in claim 1 of U.S. Pat. No. 4,774,181 (especially, Compounds 1 to 11 in columns 7 to 10).

Development Accelerator-releasing or Foggant-releasing Compounds:

Compounds of formulae (1), (2) and (3) in U.S. Pat. No. 4,656,123, column 3 (especially, (1-22) in column 25); ExZK-2 in EP 450,637A2, page 75, lines 36 to 38.

Compounds releasing a group that becomes a dye only after released:

Compounds of formula (I) in claim 1 of U.S. Pat. No. 4,857,447 (especially, Y-1 to Y-19 in columns 25 to 36).

Preferred additives other than couplers are the following:

Dispersion Media for Oil-soluble Organic Compounds:

P-3, 5, 16, 19, 25, 30, 42, 49, 54, 55, 66, 81, 85, 86 and 93 in JP-A 62-215272 (pages 140 to 144).

Latexes for Impregnation of Oil-soluble Organic Compounds:

Latexes described in U.S. Pat. No. 4,199,363.

Scavengers for Oxidation Products of Developing Agents:

Compounds of formula (I) in U.S. Pat. No. 4,978,606, column, 2, lines 54 to 62 (especially, I-(1), (2), (6) and (12) in columns 4 to 5); compounds of formulae in U.S. Pat. No. 4,923,787, column 2, lines 5 to 10 (especially, Compound 1 in column 3).

Anti-staining Agents:

Compounds of formulae (I) to (III) in EP 298,321A, page 4, lines 30 to 33 (especially, I-47 and 72, III-1 and 27 in pages 24 to 28).

Anti-fading Agents:

A-6, 7, 20, 21, 23, 24, 25, 26, 30, 37, 40, 42, 48, 63, 90, 92, 94 and 164 in EP 298,321A, pages 69 to 118; II-1 to III-23, especially III-10, in U.S. Pat. No. 5,122,444, column 25 to 38; I-1 to III-4, especially II-2, in EP 471,347A, pages 8 to 12; A-1 to 48, especially A-39 and 42, in U.S. Pat. No. 5,139,931, columns 32 to 40.

Materials for Reducing Effective Amounts of Coloring Enhancers or Color Mixing Preventing Agents:

I-1 to II-15, especially I-46, in EP 411,324A, pages 5 to 24.

Formalin Scavengers:

SCV-1 to 28, especially SCV-8, in EP 477,932A, pages 24 to 29.

Hardening Agents:

H-1, 4, 6, 8 and 14 in JP-A 1-214845, page 17; compounds (H-1 to 54) of formulae (VII) to (XII) in U.S. Pat. No. 4,618,573, columns 13 to 23; compounds (H-1 to 76, especially H-14) of formula (6) in JP-A2-214852, page 8, right bottom column; compounds stated in claim 1 in U.S. Pat. No. 3,325,287.

Development Inhibitor Precursors:

P-24, 37 and 39 in JP-A 62-168139, pages 6 to 7; compounds stated in claim 1 in U.S. Pat. No. 5,019,492, especially Compounds 28 and 29 in column 7.

Antiseptics, Antifungal Agents:

I-1 to III-43, especially II-1, 9, 10 and 18 and III-25, in U.S. Pat. No. 4,923,790.

Stabilizers, Antifoggants:

I-1 to (14), especially I-1 and 60, (2) and (13), in U.S. Pat. No. 4,923,793; Compounds 1 to 65, especially 36, in U.S. Pat. No. 4,952,483, columns 25 to 32.

Chemical Sensitizing Agents:

Triphenylphosphine selenide; Compound 50 in JP-A 5-40324.

Dyes:

In JP-A 3-156450, a-1 to b-20, especially a-1, 12, 18, 27, 35, and 36, b-5 (pages 15 to 18), and V-1 to 23, especially V-1 (pages 27 to 29); in EP 445627A, Fu-I-1 to F-II-43, especially F-I-11 and F-II-8 (pages 33 to 55); in EP 457153A, III-1 to 36, especially III-1 and 3, in pages 17 to 28; fine crystalline dispersions of Dye-1 to 124 in WO88/04794, pages 8 to 26; Compounds 1 to 22, especially Compound 1, in EP 319999A, pages 6 to 11; Compounds D-1 to 87 of formulae (1) to (3) in EP 519,306A, pages 3 to 28; Compounds 1 to 22 of formula (I) in U.S. Pat. No. 4,268,622, columns 3 to 10; Compounds (1) to (31) of formula (I) in U.S. Pat. No. 4,923,788, columns 2 to 9.

UV Absorbents:

Compounds (18b) to (18r) and 101 to 427 of formula (1) in JP-A 46-3335, pages 6 to 9; in EP 520,938A, Compounds (3) to (66) of formula (I) (pages 10 to 44) and Compounds HBT-1 to 10 of formula (III) (page 14); Compounds (1) to (31) of formula (1) in EP 521,823A, columns 2 to 9.

The present invention may apply to various color photographic materials, such as color negative films for general use or for movie use, color reversal films for slide use or for television use, as well as color papers, color positive films and color reversal papers. In addition, it is suitable for lens-combined film units such as those described in JP-B 2-32615 (the term "JP-B"as used herein means an "examined Japanese patent publication") and examined Japanese Utility Model Publication No. 3-39784.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support of having emulsion layers is 28 microns or less, preferably 23 microns or less, more preferably 18 microns or less, especially preferably 16 microns or less, in the photographic material of the present invention. It is also desired that the photographic material of the invention has a film swelling rate ($T_{1/2}$) of 30 seconds or less, preferably 20 seconds or less. The film swelling rate ($T_{1/2}$) is defined as follows: 90% of the maximum swollen thickness of the photographic material as processed in a color developer under the condition of 30° C. for 3 minutes and 15 seconds is referred to as a saturated swollen thickness. The time necessary for attaining a half (½) of the saturated swollen thickness is defined to be a film swelling rate ($T_{1/2}$). The film thickness as referred to herein is one as measured under controlled conditions of a temperature of 25° C. and a relative humidity of 55% (for 2 days); and the film swelling rate ($T_{1/2}$) may be measured by a swellometer of the model described in A. Green et al., *Photographic Science and Engineering*, Vol. 19, No. 2, pages 124 to 129. The film swelling rate ($T_{1/2}$) can be adjusted by adding a hardening agent to gelatin used as a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

The photographic material of the present invention may have a hydrophilic colloid layer (this is referred to as a backing layer)having a total dry thickness of from 2 μm to 20 μm on the side opposite to the side having the emulsion layers. It is preferred that the backing layer contains the above-mentioned light absorbent, filter dye, ultraviolet absorbent, antistatic agent, hardening agent, binder, plasticizer, lubricant, coating aid and surfactant. The backing layer is desired to have a swelling degree of from 150 to 500%.

The photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. As specific examples and preferred examples, are mentioned the compounds described in EP 556,700A, page 28, lines 43 to 52. These compounds can be used in combination of two or more of them, in accordance with the object.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines (e.g., N,N-biscarboxymethylhydrazine), phenylsemicarbazides, triethanolamine, catecholsulfonic acids; organic solvents such as ethylene glycol, and diethylene glycol; development accelerators such as benzyl alcohol, polyethylene glycol, quaternary ammonium salts, and amines; dye-forming couplers; competing couplers; auxiliary developing agents such as 1-phenyl-3-pyrazolidone; tackifiers; as well as various chelating agents such as aminopolycarboxylic acids, aminopolyphosphonic acids, alkylphosphonic acids, and phosphonocarboxylic acids. Examples of chelating agents include ethylenediamine-tetraacetic acid, nitrilotriacetic acid, diethylenetriamine-pentaacetic acid, cyclohexanediamine-tetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylene-phosphonic acid, ethylenediamine-di(o-hydroxyphenylacetic acid) and their salts.

Where the photographic material is processed by a reversal processing, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination of them. The color developer and the black-and-white developer generally has a pH value of from 9 to 12. The amount of the replenisher to the developer is, though depending upon the the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The effect of the processing solution in the processing tank is lowered, when the solution is kept in contact with air in the tank, depending on the opening ratio which is defined by the following formula:

$$\text{Opening Ratio} = (\text{Contact Surface Area } (cm^2) \text{ of Processing Solution with Air})/(\text{Volume } (cm^3) \text{ of Processing Solution})$$

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A 1-82033 and employment of the slit-developing method described in JP-A 63-216050. Reduction of the opening ratio is preferably applied to not only the both steps of color development and black-and-white development but also all the subsequent steps such as bleaching, bleach-fixation, fixation, rinsing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediaminetetraacetic acid, methyliminodiacetic acid, 1,3-diaminopropane-tetraacetic acid or glycol ether-diaminetetraacetic acid or with organic acids such as citric acid, tartaric acid or malic acid. Among them, aminopolycarboxylato/iron(III) complexes such as ethylenediaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the prebath thereof may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, DE 1,290,812 and 2,059,988, JP-A 53-32736, 53-57831, 53-37418, 53-72623, 53-95630, 53-95631, 53-104232, 53-124424, 53-141623 and 53-28426, RD No. 17129 (July, 1978); thiazolidine derivatives as described in JP-A 50-140129; thiourea derivatives as described in JP-B 45-8506, JP-A 52-20832 and 53-32735 and U.S. Pat. No. 3,706,561; iodide salts as described in DE 1,127,715 and JP-A 58-16235; polyoxyethylene compounds as described in DE 966,410 and 2,748,430; polyamine compounds as described in JP-B 45-8836; other compounds as described in JP-A 49-40943, 49-9644, 53-94927, 54-35727, 55-26506 and 58-163940; and bromide ions. Above all, mercapto group- or disulfide group-containing compounds, in particular, those as described in U.S. Pat. No. 3,893,858, DE 1,290,812 and JP-A 53-95630 are preferred, as having a large accelerating effect. In addition, compounds described in U.S. Pat. No. 4,552,834 are also preferred. These bleaching accelerators may be incorporated into the photographic material of the invention. Where the material of the invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the invention, usable are thiosulfates, thiocyanates, thioether compounds, thioureas, and a large amount of iodide salts. Use of thiosulfates is general for the purpose. Above all, ammonium thiosulfate is most widely used. Additionally, combination of thiosulfates and thiocyanates, thioether compounds or thioureas is also preferred. As the preservative to be in the fixing solution or bleach-fixing solution, preferred are sulfites, bisulfites and carbonyl-bisulfite adducts, as well as sulfinic acid compounds as described in 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contains compounds having a pKa value of from 6.0 to 9.0, for the purpose of adjusting the pH value of the solution. As such compounds, preferably added are imidazoles such as imidazole, 1-methylimidazole, 1-ethylimidaozle or 2-mehtylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

in the desilvering process, it is desired that stirring of the processing solution during the process is promoted as much as possible. Examples of reinforced stirring means include a method of running a jet stream of the processing solution to the emulsion-coated surface of the material, as described in JP-A 62-183460; a method of promoting the stirring effect by the use of a rotating means, as described in JP-A 62-183461; a method of moving the photographic material in the processing bath while the emulsion-coated surface of the material is brought into contact with a wiper blade as provided in the processing bath, whereby the processing solution as applied to the emulsion-coated surface of the material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote application of the bleaching agent and fixing agent into the emulsion layer of the photographic material and, as a result, the desilvering rate would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine is equipped with a photographic material-conveying means as described in JP-A 60-191257, 60-191258 and 60-191259. As is noted from the related disclosure of JP-A 60-191257, the conveying means may noticeably reduce the carry-over amount from the previous bath to the subsequent bath and therefore it is extremely effective for preventing deterioration of the processing solution. Because of the reasons, the conveying means is especially effective for shortening the processing time in each processing step and for reducing the amount of the replenisher to each processing bath.

The photographic material of the present invention is generally rinsed in water and/or stabilized, after being desilvered. The amount of the water to be used in the rinsing step can be set in a broad range, in accordance with the characteristic of the photographic material (for example, depending upon the raw material components, such as the coupler and so on) or the use of the material, as well as the temperature of the rinsing water, the number of the rinsing tanks (the number of the rinsing stages), the replenishment system of normal current or countercurrent and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers*, Vol. 64, pages 248 to 253 (May, 1955). According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. To overcome this problem, the method of reducing calcium and magnesium ions, which is described in JP-A 62-288838, can extremely effectively be used. In addition, isothiazolone compounds and thiabendazoles described in JP-A 57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsu-kai, Japan), and *Encyclopeadia of Bactericidal and Fungicidal Agents*, edited by Nippon Bactericide and Fungicide Association, Japan (1986), can also be used.

The pH value of the rinsing water to be used for processing the photographic material of the present invention is from 4 to 9, preferably from 5 to 8. The temperature of the rinsing water and the rinsing time can also be set variously in accordance with the characteristics of the photographic material as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A 57-8543, 58-4834 and 60-220345, can be employed.

In addition, the material can also be stabilized, following the rinsing step. As one example of the case, there may be mentioned a stabilizing bath containing a dye stabilizer and a surfactant, which is used as a final bath for picture-taking color photographic materials. Examples of the dye stabilizers include aldehydes such as formalin and glutaraldehyde, N-methylol compounds, hexamethylenetetramine and aldehyde-sulfite adducts. The stabilizing bath may also contain various chelating agents and fungicides.

The overflow of the rinsing and/or stabilizing solutions caused by addition of replenishers thereto may be re-used in the other steps such as a desilvering step.

Where the photographic material is processed with an automatic developing machine system and the processing solutions in the step are evaporated and thickened, it is desired to add water to the solutions so as to compensate the concentration of the solutions.

The photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A 53-135628, as the precursors.

The photographic material of the present invention can contain various kinds of 1-phenyl-3-pyrazolidones, if desired, for the purpose of accelerating the color developability thereof. Specific examples of these compounds are described in JP-A 56-64339, 57-144547 and 58-115438.

The processing solutions to be used for processing the photographic material of the invention are used at 10° C. to 50° C. In general, a processing temperature of from 33° C. to 38° C. is standard, but the temperature may be made higher than 38° C. so as to accelerate the processing or to shorten the processing time, or on the contrary, the temperature may be made lower than 33° C. so as to improve the quality of images formed and to improve the stability of the processing solution.

The photographic material of the present invention may contain an anionic latex polymer such as that described in EP 535,535A. In the photographic material of the present invention, the layer containing the anionic latex polymer is positioned remoter from the support relative to the two silver halide emulsion layers each having a different color sensitivity, so that it may act as a barrier layer which reflects the anionic development inhibitor released form the DIR compound contained therein to thereby enhance its inter-image effect (IIE) and to prevent the released development inhibitor from dissolving out into processing solutions.

Such a latex polymer comprises a copolymer of vinyl monomers, containing monomers having an anionic pendant group (e.g., sulfo, sulfino, carboxy, oxysulfo, phosphono, oxyphosphono, etc., or their salts) in an amount of preferably from 1% by weight to 20% by weight, more preferably from 3% by weight to 10% by weight.

The latex polymer is preferably added to a non-light-sensitive layer, especially preferably to a protective layer or an filter layer. Where the material has two or more protective layers, the latex polymer is preferably added to the first protective layer which is the nearest to the support.

The amount of the latex polymer to be added to the photographic material of the present invention is preferably from 0.1 to 3.0 g/m$^2$, more preferably from 0.3 to 2.0 g/m$^2$, and especially preferably from 0.5 to 1.5 g/m$^2$.

Specific examples of the latex polymer are mentioned below, in which the proportions of the monomers are parenthesized and represented by % by weight.

L-1: N-butyl acrylate/2-acrylamido-2-methylpropanesulfonic acid/2-acetacetoxyethyl methacrylate (88/5/7)

L-2: N-butyl acrylate/styrene/methylacrylamide/2-acrylamido-2-methylpropanesulfonic acid (59/25/8/8)

L-3: N-butyl acrylate/2-acrylamido-2-methylpropanesulfonic acid (95/5)

L-4: N-butyl acrylate/styrene/2-acrylamido-2-methylpropanesulfonic acid (85/10/5)

L-5: N-butyl acrylate/styrene/2-acrylamido-2-methylpropanesulfonic acid (65/30/5)

The photographic material of the present invention may have a reflective layer which contains from $1\times10^{-5}$ to $4\times10^{-3}$ mol/g of a polymer containing ion-forming functional groups, such as that described in EP 539,729A, and which reflects the development inhibitor released from the DIR compound in the material.

The polymer is preferably added to a light-insensitive layer between two silver halide emulsion layers each having a different color sensitivity so that it may act as a barrier layer against the diffusion of the anionic development inhibitor so as to reduce its inter-image effect (IIE) and to enhance the effect of the DIR compound against the layer itself containing the compound, thereby improving the sharpness of the material.

The polymer is a copolymer of vinyl monomers, which is composed of at least one hydrophobic vinyl monomer (e.g., acrylates, methacrylates, acrylamides, methacrylamides) and at least one hydrophilic monomer having an ion-forming functional group (e.g., primary amine, sulfo, sulfino, carboxyl, oxysulfo, phosphono, oxyphosphono, etc. and their salts). The polymer is preferably added to light-insensitive layers, especially to an interlayer between the red-sensitive silver halide emulsion layer and the green-sensitive silver halide emulsion layer or to an interlayer between the green-sensitive silver halide emulsion layer and the blue-sensitive silver halide emulsion layer. If desired, the polymer may also be added to light-sensitive layers or to an interlayer between two silver halide emulsion layers both having the same color sensitivity but each having a different sensitivity degree.

The amount of the polymer to be added to the photographic material of the present invention may be from 0.1 to 2.0 g/m$^2$, preferably from 0.2 to 1.5 g/m$^2$, more preferably from 0.5 to 1.0 g/m$^2$.

Specific examples of the polymer are mentioned below, in which the proportions of the monomers are parenthesized and represented by % by weight.

P-1: N-isopropylacrylamide/N-(3-aminopropyl-)methacrylamide hydrochloride (90/10)

P-2: N-t-butylacrylamide/N-(3-aminopropyl)methacrylamide hydrochloride (80/20)

P-3: N-t-butylacrylamide/allylamine sulfate (92/8)

P-4: N-butyl methacrylate/aminoethyl methacrylate hydrochloride/hydroxyethyl methacrylate (50/30/20)

P-5: N-butyl methacrylate/sulfoethyl methacrylate sodium salt/2-acetacetoxyethyl methacrylate/hydroxyethyl methacrylate (60/5/10/25)

P-6: N-t-butylacrylamide/acrylamide/N-2-carboxyethylacrylamide/N-(3-aminopropyl)methacrylamide hydrochloride (65/20/5/10)

Next, the present invention will be explained in more detail with reference to the following examples, which, however, are not intended to restrict the scope of the present invention.

EXAMPLE 1

Layers each having the composition mentioned below were multicoated on a subbing layer-coated cellulose triacetate support, after having coated an anti-halation layer on the support, to prepare a photographic material sample No. 101. The number for each component indicates the amount coated by way of a unit of g/m$^2$. The amount of each silver halide emulsion coated is represented as the amount of silver therein coated.

| | |
|---|---|
| Red-sensitive Silver Halide Emulsion Layer (Interlayer Effect Donor Layer): | |
| Silver Iodobromide Emulsion 1 | 0.425 |
| Silver Iodobromide Emulsion 2 | 0.772 |
| Coupler A | 0.738 |
| DIR Compound D-a | 0.050 |
| Tricresyl Phosphate | 0.284 |
| Gelatin | 2.214 |
| Interlayer: | |
| Color Mixing Preventing Agent | 0.096 |
| Tricresyl Phosphate | 0.050 |
| Gelatin | 0.638 |
| Green-sensitive Silver Halide Emulsion Layer (Interlayer Effect Receiver Layer): | |
| Silver Iodobromide Emulsion 3 | 0.297 |
| Silver Iodobromide Emulsion 4 | 0.297 |
| Coupler B | 0.458 |
| Tricresyl Phosphate | 0.490 |
| Gelatin | 1.319 |
| Protective Layer: | |
| Gelatin | 2.200 |

The structures of the couplers and the color mixing preventing agent used in preparing the above-mentioned sample are mentioned below.

Coupler A

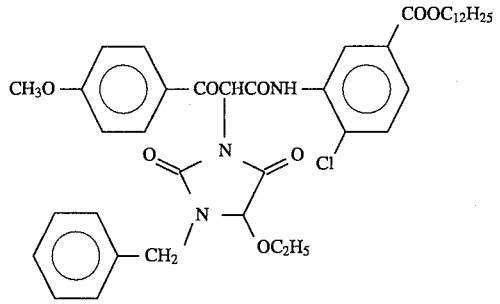

-continued

Coupler B

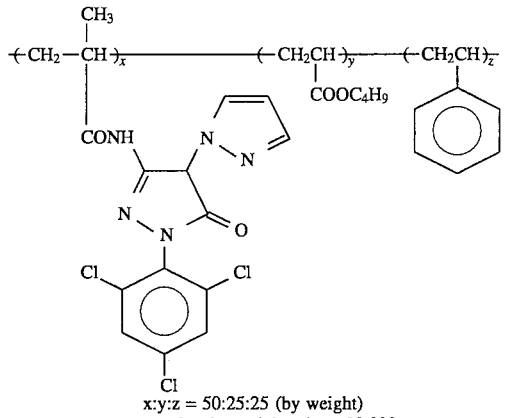

x:y:z = 50:25:25 (by weight)
mean molecular weight: about 20,000

Color Mixing Preventing Agent:

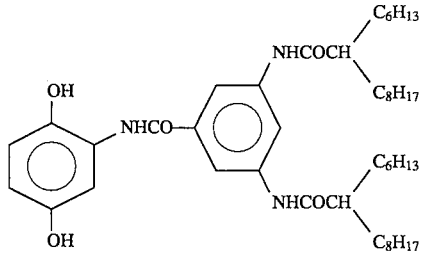

DIR Compound D-a:

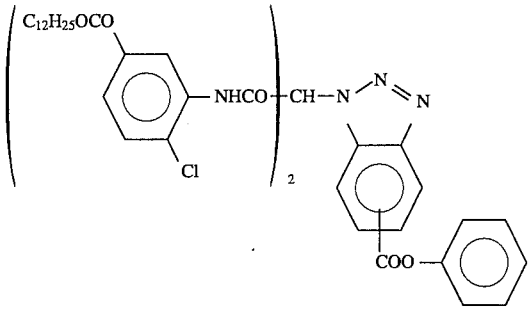

This coupler (15) described in U.S. Pat. No. 4,477,563.

The characteristic values of Silver Iodobromide Emulsions 1 to 4 are mentioned below.

TABLE 1

| | Mean AgI Content (mol %) | Fluctuation Coefficient Relative to AgI Content in Grains (%) | Mean Grain Size (as the diameter of the corresponding circle) (μm) | Fluctuation Coefficient Relative to Grain Size (%) | Diameter of Circle Corresponding to Projected Area (μm) | Ratio of Diameter/-Thickness |
|---|---|---|---|---|---|---|
| Emulsion 1 | 1.8 | 11 | 0.46 | 14 | 0.56 | 5.5 |
| Emulsion 2 | 9.0 | 24 | 0.67 | 23 | 0.88 | 5.8 |
| Emulsion 3 | 1.8 | 11 | 0.46 | 14 | 0.56 | 5.8 |
| Emulsion 4 | 9.0 | 24 | 0.61 | 23 | 0.77 | 4.4 |

Emulsions 1 to 4 were sensitized by gold sensitization, sulfur sensitization and selenium sensitization in the presence of spectrally sensitizing dyes and sodium thiocyanate, according to the example in JP-A 3-237450. In preparing the tabular grains, a low-molecular weight gelatin was used according to the example in JP-A 158426. Dislocation lines such as those described in JP-A 3-237450 were found in the tabular grains, when the grains were observed with a high-pressure electronic microscope.

Sample Nos. 102 to 134 were prepared in the same manner as in preparation of Sample No. 101, except that the DIR compound of formula (I) of the present invention or the comparative DIR compound as indicated in Tables 2 and 3 below was added to the red-sensitive silver halide emulsion layer in place of DIR compound D-a. The amount of the DIR compound to be added to each sample was determined in such a way that, when the sample was wedgewise exposed to a white light at 4800° K. for sensitometry and then developed according to the process mentioned below, the gamma value (γd) on the characteristic curve for the yellow density obtained might be about 65% of the gamma value (γd) on the same of the corresponding sample not containing the DIR compound. The structures of the comparative compounds used are mentioned below.

D-b

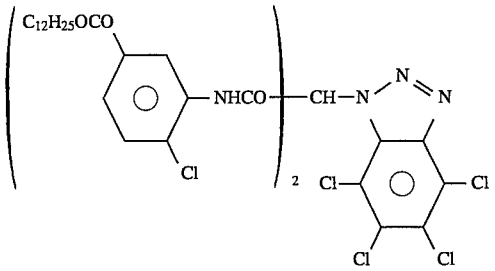

(Coupler 20 described in U.S. Pat. No. 5,006,4552)

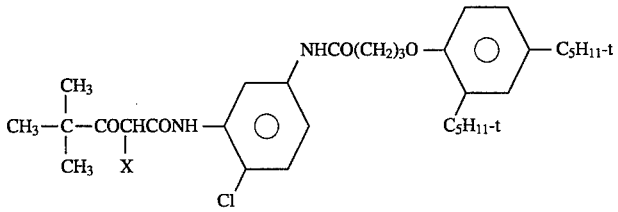

D-c

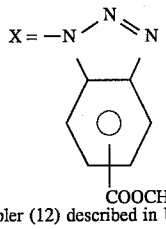

(Coupler (12) described in U.S. Pat. No. 4,477,563)

D-d

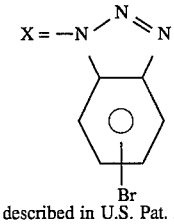

(Coupler 11 described in U.S. Pat. No. 3,933,500)

D-e

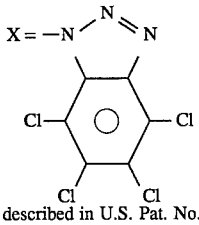

(Coupler 1 described in U.S. Pat. No. 5,006,452)

D-f

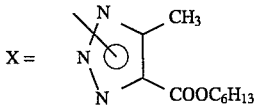

-continued

D-g

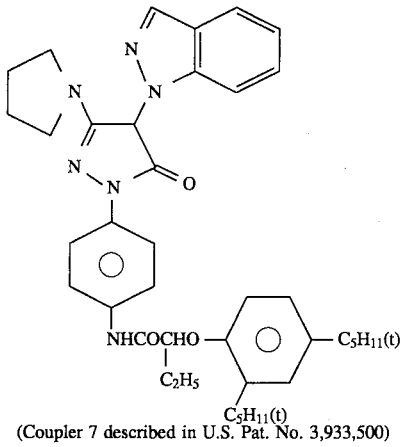

(Coupler 7 described in U.S. Pat. No. 3,933,500)

D-h

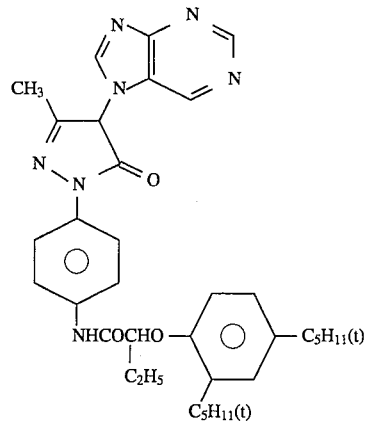

(Coupler 13 described in U.S. Pat. No. 3,933,500)

The red-sensitive emulsion layer is an interlayer effect donor layer, while the green-sensitive emulsion layer is an interlayer effect receiver layer. The ratio of the γ values of these layers, γd/γr is the criterion for indicating the interlayer effect in the sample. γr means the gamma value measured for the magenta density.

The sharpness of each sample was measured according to the MTF (modulation transfer function) method, after each sample was processed in the same manner as above. Briefly, the MTF value for the yellow image of each sample was obtained at 20 cycles/mm and represented as a relative value based on the value of Sample No. 101.

TABLE 2

| Sample No. | DIR Compound | Amount of DIR Compound Added (μmol/m2) | Interlayer Effect (γd/γr) × 100 | Sharpness (MTF, as relative value) | Remarks |
|---|---|---|---|---|---|
| 101 | D-a | 48 | 111 | 100 | Comparison |
| 102 | D-b | 44 | 106 | 96 | Comparison |
| 103 | D-2 | 36 | 121 | 108 | Invention |
| 104 | D-4 | 40 | 117 | 108 | Invention |
| 105 | D-13 | 44 | 115 | 103 | Invention |
| 106 | D-21 | 44 | 116 | 104 | Invention |
| 107 | D-c | 112 | 106 | 101 | Comparison |
| 108 | D-d | 96 | 105 | 101 | Comparison |
| 109 | D-e | 88 | 103 | 97 | Comparison |
| 110 | D-f | 102 | 102 | 96 | Comparison |
| 111 | D-19 | 76 | 113 | 106 | Invention |
| 112 | D-64 | 88 | 112 | 105 | Invention |
| 113 | D-g | * | * | * | Comparison |
| 114 | D-h | * | * | * | Comparison |
| 115 | D-65 | 56 | 115 | 106 | Invention |
| 116 | D-66 | 52 | 114 | 106 | Invention |
| 117 | D-1 | 60 | 110 | 104 | Invention |
| 118 | D-3 | 52 | 116 | 109 | Invention |
| 119 | D-5 | 64 | 112 | 105 | Invention |

*: The development inhibiting effect of the compound added was so poor that the γd value of the sample did not reach 65% of the γd value of the corresponding sample containing no DIR compound.

TABLE 3

| Sample No. | DIR Compound | Amount of DIR Compound Added (μmol/m2) | Interlayer Effect (γd/γr) × 100 | Sharpness (MTF, as relative value) | Remarks |
|---|---|---|---|---|---|
| 120 | D-6 | 68 | 111 | 105 | Invention |
| 121 | D-10 | 52 | 118 | 109 | Invention |

TABLE 3-continued

| Sample No. | DIR Compound | Amount of DIR Compound Added (μmol/m2) | Interlayer Effect (γd/γr) × 100 | Sharpness (MTF, as relative value) | Remarks |
|---|---|---|---|---|---|
| 122 | D-11 | 56 | 114 | 106 | Invention |
| 123 | D-20 | 72 | 111 | 104 | Invention |
| 124 | D-22 | 56 | 114 | 105 | Invention |
| 125 | D-23 | 48 | 117 | 107 | Invention |
| 126 | D-25 | 52 | 118 | 109 | Invention |
| 127 | D-30 | 52 | 120 | 109 | Invention |
| 128 | D-34 | 48 | 117 | 107 | Invention |
| 129 | D-35 | 60 | 113 | 105 | Invention |
| 130 | D-41 | 56 | 114 | 107 | Invention |
| 131 | D-49 | 84 | 112 | 105 | Invention |
| 132 | D-52 | 52 | 115 | 108 | Invention |
| 133 | D-56 | 52 | 114 | 108 | Invention |
| 134 | D-63 | 60 | 113 | 104 | Invention |

Development of the samples was effected according to the process mentioned below.

Process for Development:

| Step | Processing Time | Processing Temperature |
|---|---|---|
| Color Development | 2 min 45 sec | 38° C. |
| Bleaching | 3 min 00 sec | 38° C. |
| Rinsing | 30 sec | 24° C. |
| Fixation | 3 min 00 sec | 38° C. |
| Rinsing (1) with water | 30 sec | 24° C. |
| Rinsing (2) with water | 30 sec | 24° C. |
| Stabilization | 30 sec | 38° C. |
| Drying | 4 min 20 sec | 55° C. |

The compositions of the processing solutions used above are mentioned below.

| Color Developer: | |
|---|---|
| Diethylenetriamine-pentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-[N-ethyl-N-(β-hydroxyethyl)amino]-2-methylaniline Sulfate | 4.5 g |
| Water to make | 1.0 liter |
| pH (adjusted with potassium hydroxide and sulfuric acid) | 10.05 |
| **Bleaching Solution:** | |
| Sodium Ethylenediamine-tetraacetato/Fe(III) Trihydrate | 100.0 g |
| Disodium Ethylenediamine-tetraacetate | 10.0 g |
| 3-Mercapto-1,2,4-triazole | 0.03 g |
| Ammonium Bromide | 140.0 g |
| Ammonium Nitrate | 30.0 g |
| Aqueous Ammonia (27%) | 6.5 ml |
| Water to make | 1.0 liter |
| pH (adjusted with aqueous ammonia and nitric acid) | 6.0 |
| **Fixer:** | |
| Disodium Ethylenediamine-tetraacetate | 0.5 g |
| Ammonium Sulfite | 20.0 g |
| Aqueous Solution of Ammonium Thiosulfate (700 g/liter) | 295.0 ml |
| Acetic Acid (90%) | 3.3 g |
| Water to make | 1.0 liter |
| pH (adjusted with aqueous ammonia and acetic acid) | 6.7 |
| **Stabilizer:** | |

-continued

| | |
|---|---|
| Sodium P-toluenesulfinate | 0.03 g |
| Polyoxyethylene P-monononylphenyl Ether (mean degree of polymerization: 10) | 0.2 g |
| Disodium Ethylenediamine-tetraacetate | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH | 8.5 |

The results obtained are summarized in Tables 2 and 3 above. The amount of the DIR compound to be added to each sample was determined in such a way that its gamma value on the characteristic curve for the yellow density to be obtained by wedgewise exposure to a white light might be about 65% of the gamma value on the same of the corresponding sample not containing the DIR compound. Therefore, the smaller amount of the DIR compound added means that the DIR compound released its development inhibitor therefrom at a higher speed during development or that the development-inhibiting activity of the development inhibitor released was stronger.

The ratio γd/γr indicates the relative comparison between the gamma value of the interlayer effect donor layer and that of the interlayer effect receiver layer. The larger ratio means that the inhibition of development of other layers (not containing the DIR compound) is relatively larger than that of the layer containing the DIR compound therein. In other words, it means that the DIR compound added had a larger interlayer effect.

The sharpness of each sample was represented as a relative value of the MTF value of its yellow image at 20 cycles/mm, based on the MTF value of Sample No. 101 of being 100. The larger value means that the sharpness of the sample is higher.

In Tables 2 and 3 above, Sample Nos. 101 to 106 were compared with each other. The DIR compounds used in preparing these samples had the same malondianilide mother nucleus but had a development inhibitor-releasing group of the present invention or had a known development inhibitor-releasing group. Sample Nos. 107 to 112 were compared with each other. The DIR compounds used in preparing them had the same pivaloylacetanilide mother nucleus. Testing these samples, the DIR compounds of the present invention were compared with known DIR compounds such as those described in U.S. Pat. Nos. 3,933,500, 4,477,563 and 5,006,452. From the results shown in Table 2 above, it is noted that the DIR compounds of the present invention were comparable to the known DIR compounds with respect to the effect of inhibiting the development of the layer itself containing the DIR compound, even though the amount of the former added was smaller than that of the latter. This means that the DIR compounds of the present invention released their development inhibitors more rapidly than the known DIR compounds and/or that the development inhibitors released by the DIR compounds of the present invention had a higher development-inhibiting activity than those released by the known DIR compounds. In addition, it is also noted therefrom that the interlayer effect of the DIR compounds of the present invention was larger than that of the known DIR compounds and that the sharpness of the images formed in the samples of the present invention was higher than those formed in the comparative samples.

Sample Nos. 113 to 116 were compared with each other. The DIR compounds used in them had the same 5-pyrazolone mother nucleus. Both the comparative DIR compounds (D-g) and (D-h) described in U.S. Pat. No. 3,933,500 (D-g is a coupler releasing an indazole compound, and D-h is a coupler releasing a purine compound) had a weak development-inhibiting effect. Therefore, even though 200 μmol/m$^2$ of them were added, the samples (Nos. 113 and 114) could not have the intended gamma value. As opposed to these, the samples containing the DIR compounds of the present invention (D-65, D-66) had the intended gamma value even though the amounts of the DIR compounds added were small.

Sample Nos. 117 to 134 had various compounds of formula (I) of the present invention. Though the amounts of the compounds added varied, as depending on the coupling reactivity of each coupler with the oxidation product of the developing agent used and its speed of releasing the development inhibitor from its timing group, all these samples showed an excellent interlayer effect and a high sharpness.

It is presumed that these surprising effects are resulted by the substitution of the benzene ring in known benzotriazole-type development inhibitors by a hetero ring (the present invention), causing the change in the electronic effect or the steric effect of the thus-substituted inhibitors thereby to improve the coupling reactivity of the couplers or to increase the speed thereof of releasing the inhibitor from the timing group, or causing the change in the affinity of the inhibitors to silver halides by the heterocyclic ring.

EXAMPLE 2

This experimentation was conducted to test the coloring property of couplers.

Plural layers each having the composition mentioned below were coated on a subbing layer-coated cellulose triacetate support to prepare a photographic material sample No. 201. The number for each component indicates the amount coated by using a unit of g/m$^2$. The amount of each silver halide emulsion coated is represented as the amount of silver therein coated.

| | |
|---|---|
| Red-sensitive Silver Halide Emulsion Layer: | |
| Silver Iodobromide Emulsion 1 | 1.080 |
| Coupler A | 0.748 |
| DIR Compound D-a | 0.133 |
| Tricresyl Phosphate | 0.288 |
| Gelatin | 2.100 |
| Protective Layer: | |
| Gelatin | 2.200 |

Sample Nos. 202 to 216 were prepared in the same manner as in preparation of Sample No. 201, except that Coupler D-a in Sample No. 201 was replaced by the same molar amount of the coupler shown in Table 4 below. The emulsion and the couplers used herein were same as those in Example 1.

Sample Nos. 201 to 216 were exposed to a white light through a step wedge and then developed by the same process as in Example 1.

Each of the thus-processed samples was stamped out at its part uniformly exposed at a predetermined amount for exposure to a piece having a predetermined area, and the piece was then dipped in 2 ml of a mixture of N,N-dimethylformamide/water (85/15 by volume) to thereby extract the formed azomethine dye therefrom. The resulting dye extract was analyzed by HPLC (high performance liquid chromatography) to obtain the amounts of the dyes formed from Coupler A and the other coupler. From the data thus measured, the molar ratio of the dye formed from the other coupler to that formed from Coupler A was obtained. The amount for exposure was determined in such a way that the amount of the dye to be formed from the comparative coupler D-a in Sample No. 201 might be about 25 μmol/m$^2$ for Sample Nos. 201 to 206 and that the amount of the dye to be formed from the comparative coupler D-c in Sample No. 207 might be about 30 μmol/m$^2$ for Sample Nos. 207 to 212.

The data shown in Table 4 below are relative values based on the molar ratio of the dyes formed in Sample No. 201 of being 100 for Sample Nos. 201 to 206 and those based on the molar ratio of the dyes formed in Sample No. 207 of being 100 for Sample Nos. 207 to 212. In the same manner as above, Sample No. 213 was compared with Sample No. 214, and Sample No. 215 with Sample No. 216.

TABLE 4

| Sample No. | Coupler Used | Relative Value of Molar Ratio of Dyes Formed | Remarks |
|---|---|---|---|
| 201 | D-a | 100 | Comparison |
| 202 | D-b | 104 | Comparison |
| 203 | D-2 | 136 | Invention |
| 204 | D-4 | 123 | Invention |
| 205 | D-13 | 120 | Invention |
| 206 | D-21 | 128 | Invention |
| 207 | D-c | 100 | Comparison |
| 208 | D-d | 98 | Comparison |
| 209 | D-e | 105 | Comparison |
| 210 | D-f | 96 | Comparison |
| 211 | D-19 | 141 | Invention |
| 212 | D-64 | 130 | Invention |
| 213 | D-g | 100 | Comparison |
| 214 | D-65 | 126 | Invention |
| 215 | D-h | 100 | Comparison |
| 216 | D-66 | 141 | Invention |

As shown in Table 4 above, the molar ratio of the dye formed from the coupler of the present invention to the dye formed from Coupler A was larger than that of the dye formed from the known coupler having a benzotriazole, monocyclic azole, indazole or purine type split-off group to the dye formed from Coupler A. In other words, it is understood from the data in Table 4 that the couplers of the present invention had a better coloring property than the comparative couplers. It is presumed that the difference in the coloring property between these couplers result from that the split-off group of the coupler of the present invention acts more advantageously than the conventional benzotriazole type and other known split-off groups in the electronic effect and/or the steric effect.

EXAMPLE 3

Plural layers each having the composition mentioned below were coated on a subbing layer-coated cellulose triacetate support, to prepare a multi-layer color photographic material sample 301.

Compositions of Photographic Layers:

Essential components of constituting the photographic layers are grouped as follows:

| | |
|---|---|
| ExC: | Cyan Coupler |
| UV: | Ultraviolet Absorbent |
| ExM: | Magenta Coupler |
| HBS: | High Boiling Point Organic Solvent |
| ExY | Yellow Coupler |
| H: | Gelatin Hardening Agent |
| ExS: | Sensitizing Dye |

The number for each component indicates the amount coated by using a unit of g/m$^2$. The amount of the silver halide coated is represented as the amount of silver therein coated. The amount of the sensitizing dye coated is represented by way of a molar unit to mol of the silver halide in the same layer.

| Formation of Sample 301 | |
|---|---|
| First Layer (Anti-halation Layer) | |
| Black Colloidal Silver | 0.18 as Ag |
| Gelatin | 1.60 |
| ExM-1 | 0.12 |
| ExF-1 | $2.0 \times 10^{-3}$ |
| HBS-1 | 0.15 |
| HBS-2 | 0.02 |
| Second Layer (Interlayer) | |
| Silver Iodobromide Emulsion M | 0.065 as Ag |
| ExC-2 | 0.04 |
| Polyethyl Acrylate Latex | 0.20 (solid) |
| Gelatin | 1.04 |
| Third Layer (Low-sensitivity Red-sensitive Emulsion Layer) | |
| Silver Iodobromide Emulsion A | 0.28 as Ag |
| Silver Iodobromide Emulsion B | 0.28 as Ag |
| ExS-1 | $6.9 \times 10^{-5}$ |
| ExS-2 | $1.8 \times 10^{-5}$ |
| ExS-2 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth Layer (Middle-sensitivity Red-sensitive Emulsion Layer) | |
| Silver Iodobromide Emulsion C | 0.74 as Ag |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.23 |
| HBS-1 | 0.10 |
| Gelatin | 0.75 |
| Fifth Layer (High-sensitivity Red-sensitive Emulsion Layer) | |
| Silver Iodobromide Emulsion D | 1.40 as Ag |

-continued

| Formation of Sample 301 | |
|---|---|
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth Layer (Interlayer) | |
| Cpd-1 | 0.090 |
| HBS-1 | 0.050 |
| ExF-2 | 0.040 |
| Polyethylene Acrylate Latex | 0.15 (solid) |
| B-7 | 0.50 |
| Gelatin | 1.10 |
| Seventh Layer (Low-sensitivity Green-sensitive Emulsion Layer) | |
| Silver Iodobromide Emulsion E | 0.16 as Ag |
| Silver Iodobromide Emulsion F | 0.12 as Ag |
| Silver Iodobromide Emulsion G | 0.12 as Ag |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.056 |
| ExM-6 | 0.030 |
| ExY-1 | 0.015 |
| HBS-1 | 0.30 |
| HBS-3 | 0.010 |
| Gelatin | 0.73 |
| Eighth Layer (Middle-sensitivity Green-sensitive Emulsion Layer) | |
| silver Iodobromide Emulsion H | 0.85 as Ag |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.015 |
| ExM-6 | 0.010 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth Layer (High-sensitivity Green-sensitive Emulsion Layer) | |
| Silver Iodobromide Emulsion I | 1.25 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExC-7 | 0.005 |
| ExM-1 | 0.020 |
| ExM-4 | 0.035 |
| ExM-5 | 0.040 |
| Cpd-3 | 0.040 |
| HBS-1 | 0.25 |
| Polyethyl Acrylate Latex | 0.15 |
| Gelatin | 1.33 |
| Tenth Layer (Yellow Filter Layer) | |
| Yellow Colloidal Silver | 0.15 as Ag |
| Cpd-1 | 0.16 |
| ExF-3 | 0.080 |
| HBS-1 | 0.60 |
| Gelatin | 1.33 |
| Eleventh Layer (Low-sensitivity Blue-sensitive Emulsion Layer) | |

-continued

| Formation of Sample 301 | |
|---|---|
| Silver Iodobromide Emulsion J | 0.12 as Ag |
| Silver Iodobromide Emulsion K | 0.12 as Ag |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Twelfth Layer (High-sensitivity Blue-sensitive Emulsion Layer) | |
| Silver Iodobromide Emulsion L | 1.00 as Ag |
| ExS-7 | $4.0 \times 10^{-4}$ |
| ExY-2 | 0.10 |
| ExY-3 | 0.10 |
| ExY-4 | 0.010 |
| ExC-7 | 0.005 |
| Cpd-2 | 0.10 |
| Cpd-3 | $1.0 \times 10^{-3}$ |
| HBS-1 | 0.07 |
| Gelatin | 0.7 |
| Thirteenth Layer (First Protective Layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| B-8 | 1.0 |
| Gelatin | 1.8 |
| Fourteenth Layer (Second Protective Layer) | |
| Silver Iodobromide Emulsion M | 0.10 as Ag |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

In addition, the respective layers contained any of W-1 through W-3, B-4 through B-6, F-1 through F-17, and iron salts, lead salts, gold salts, platinum salts, palladium salts, iridium salts and rhodium salts, so as to have imrpoved storability, processability, pressure resistance, anti-fungal and anti-bacterial property, antistatic property and coatability.

(1) Emulsions J to L were sensitized by reduction sensitization with thiourea dioxide and thiosulfonic acid, according to the Example in JP-A 2-191938, when the grains were prepared.

(2) Emulsions A to I were sensitized by gold sensitization, sulfur sensitization and selenium sensitization in the presence of the apectrally-sensitizing dyes described in each color-sensitive layer and sodium thiocyanate, according to the Example in JP-A 3-237450.

(3) In preparing the tabular grains, a low-molecular weight gelatin was used according to the Example in JP-A 1-158426.

(4) Dislocation lines such as those described in JP-A 3-237450 were found in the tabular grains, when the grains were observed with a high-pressure electronic microscope.

(5) Emulsion L contained two-layered grains each having an inside iodine-rich core such as those described in JP-A 60-143331.

Compounds used above are mentioned below. (In the present invention an alkyl group having no any symbol of n, iso, or t indicates normal alkyl group.)

TABLE 5

| | Mean AgI Content (mol %) | Fluctuation Coefficient Relative to AgI Content in Grains (%) | Mean Grain Size (as the diameter of the corresponding circle) (μm) | Fluctuation Coefficient Relative to Grain Size (%) | Diameter of Circle Corresponding to Projected Area (μm) | Ratio of Diameter/-Thickness |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3.7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 14.0 | 25 | 1.28 | 26 | 1.46 | 3.5 |
| Emulsion M | 1.0 | — | 0.07 | 15 | — | 1 |

In Table 5;

ExC-1
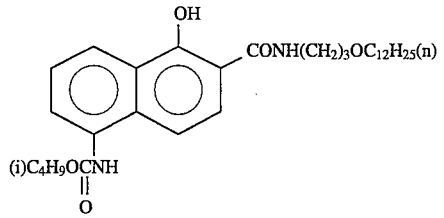
ExC-2
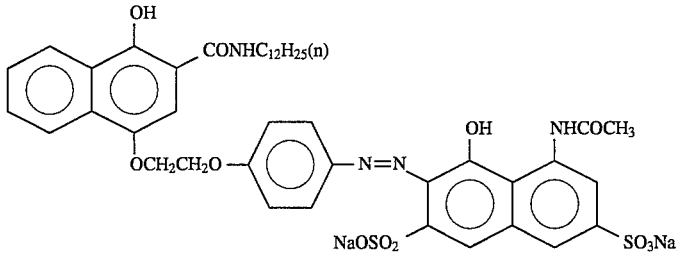
ExC-3
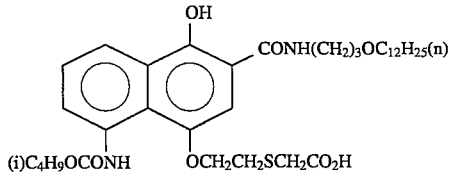
ExC-4
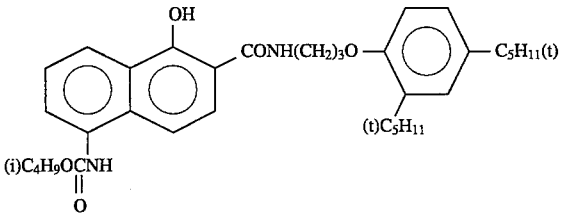
ExC-5
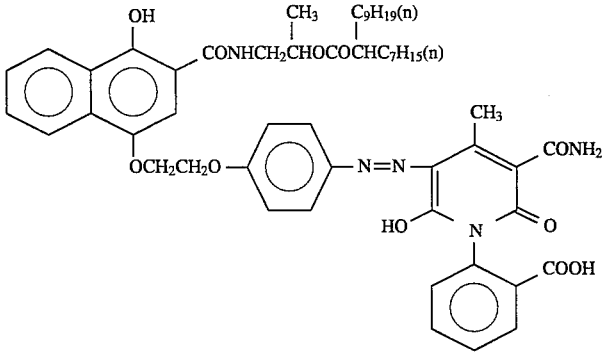
ExC-6
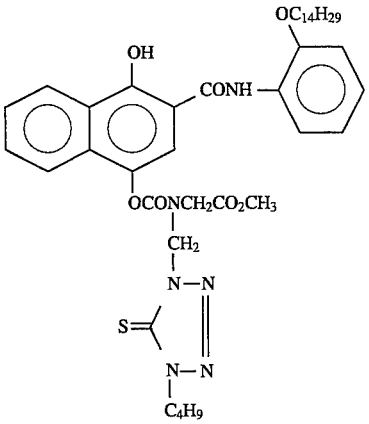
ExC-7
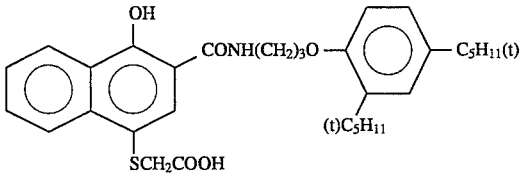

-continued
ExC-8
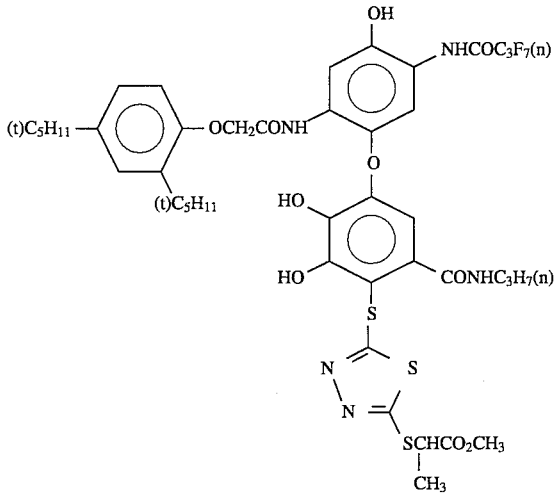
ExM-1
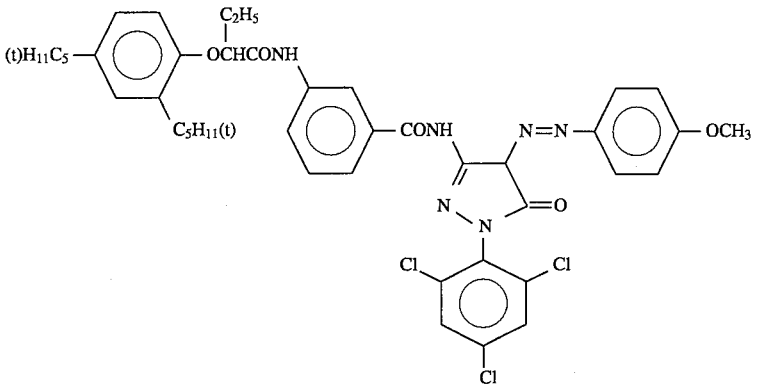
ExM-2
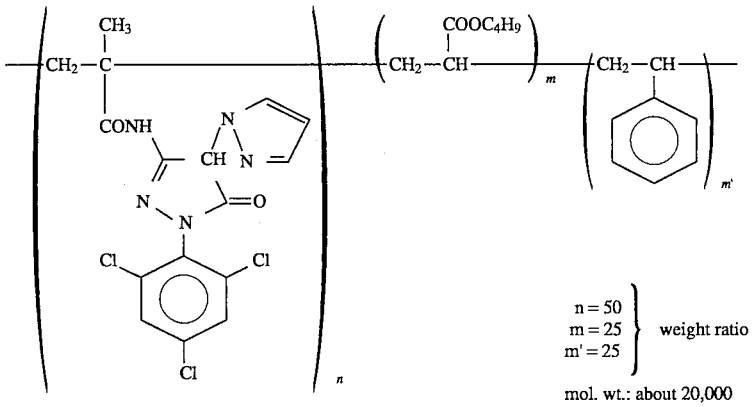
ExM-3
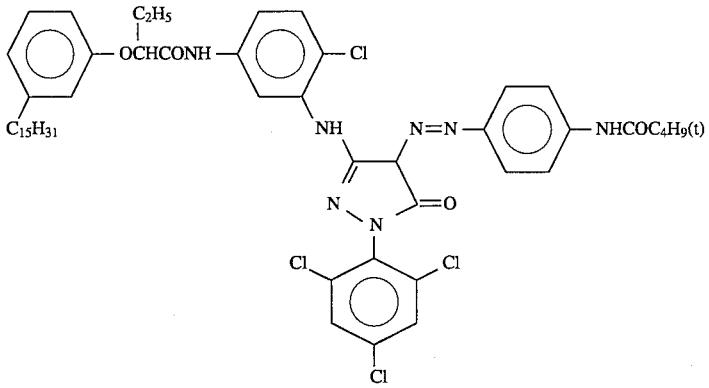

-continued
ExM-4
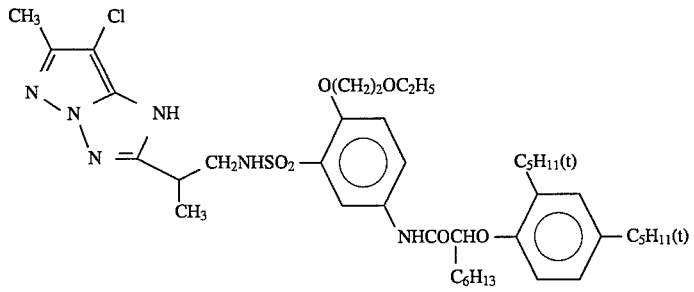
ExM-5
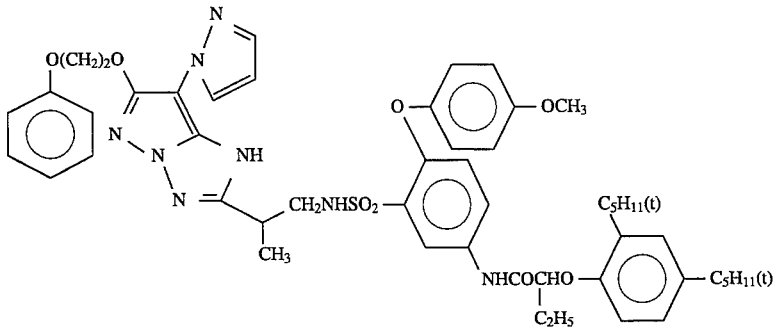
ExY-1
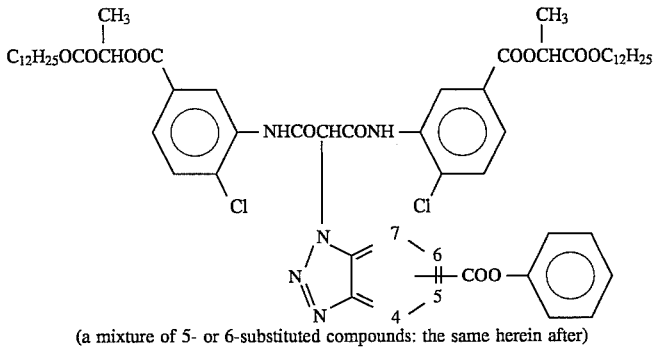
(a mixture of 5- or 6-substituted compounds: the same herein after)
ExY-2
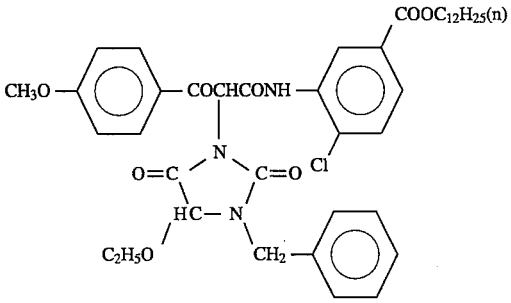
ExY-3
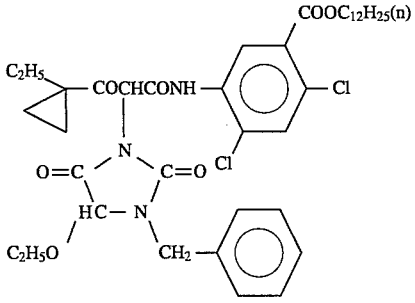
ExY-4
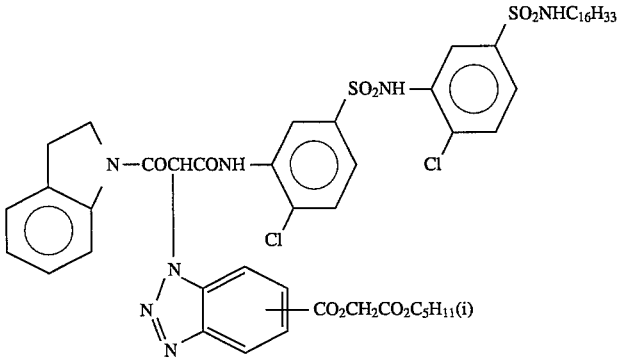

-continued
ExY-5
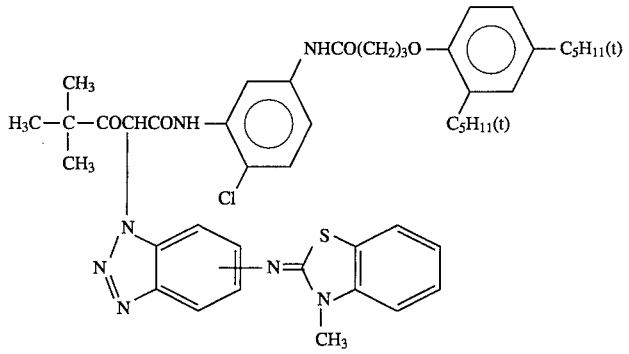
ExF-1
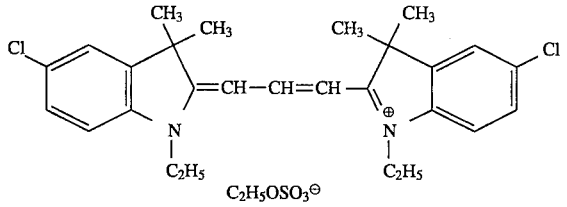
Cpd-1
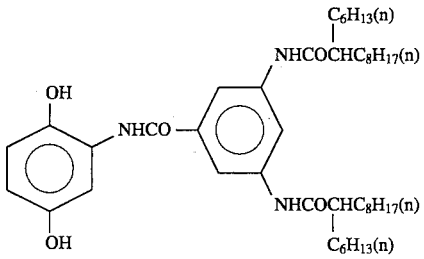
Cpd-2
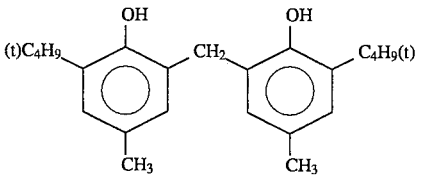
Cpd-3
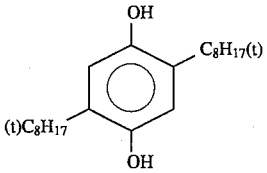
UV-1
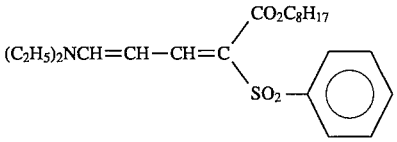
UV-2
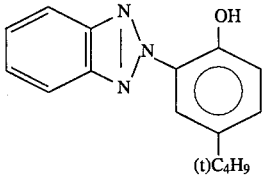
UV-3
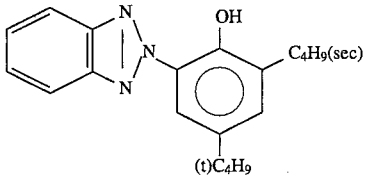
tricresylphosphate HBS-1
di-n-butylphthalate HBS-2
HBS-3
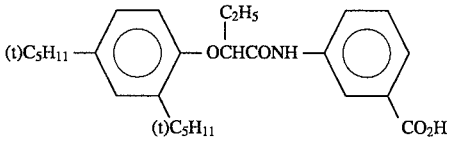
tri(2-ethylhexyl)phosphate HBS-4

-continued
ExM-6
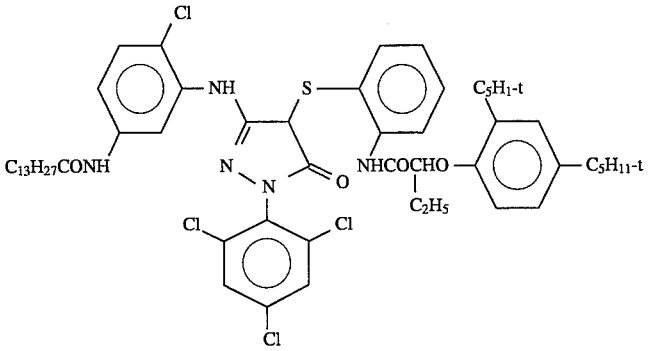
(Solid dispersion having a mean grain size of 0.5 μm)
ExF-2
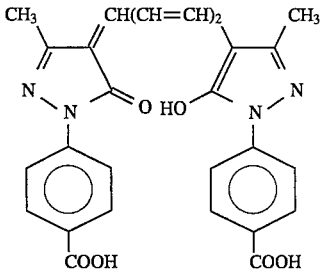
Copolymer of N-isopropylacrylamide/N-(3-aminopropyl) methacrylamide hydrochloride (90/10, by weight)
B-7
ExF-3
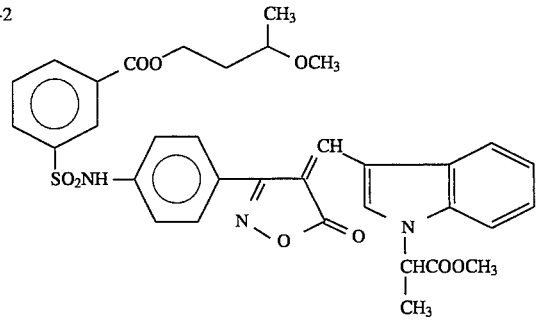
Terpolymer Latex of N-butyl acrylate/2-acrylamido-2-methylpropanesulfonic acid/2-acetacetoxyethyl methacrylate (88/5/7, by weight)
B-8
ExS-1
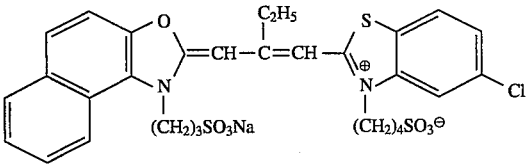
ExS-2
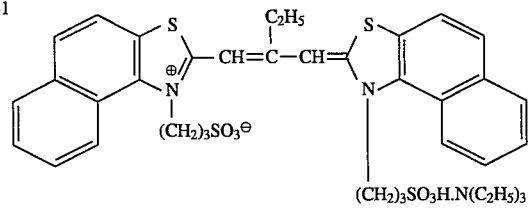
ExS-3
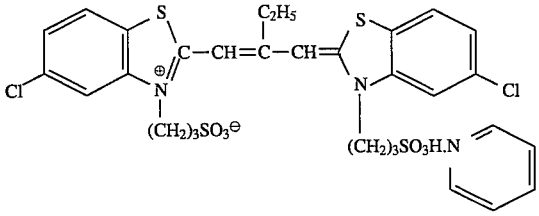
ExS-4
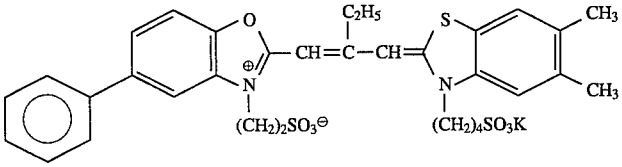
ExS-5
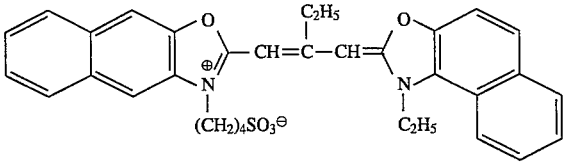

-continued
ExS-6
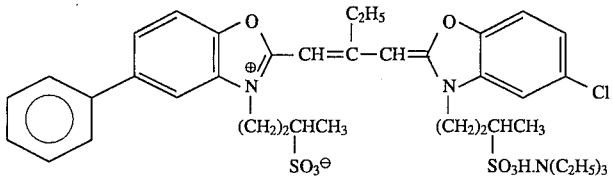
ExS-7
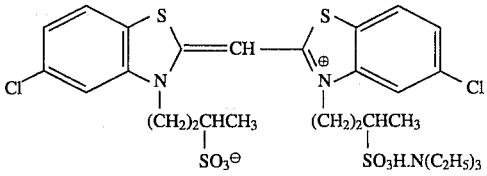
S-1
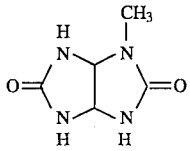
H-1
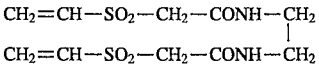
B-1
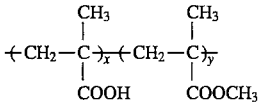
x/y = 10/90 (by weight)
B-2
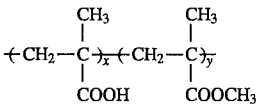
x/y = 40/60 (by weight)
B-3
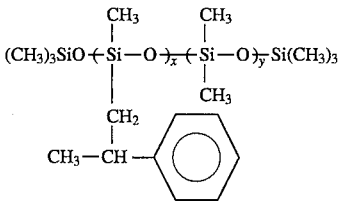
x/y = 29/46 (by weight)
B-4
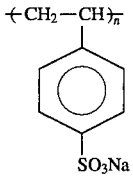
mol. wt.: about 750,000
B-5
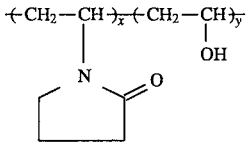
x/y = 70/30 (by weight)
B-6
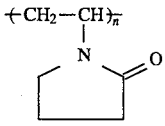
(mol. wt.: about 10,000)
W-1
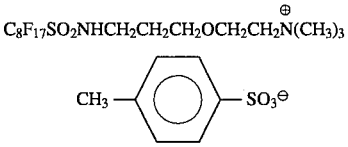
W-2
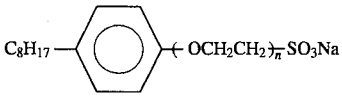
n = 2~4 (a mixture)
W-3
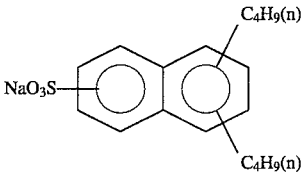
F-1
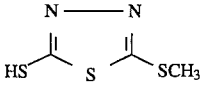
F-2
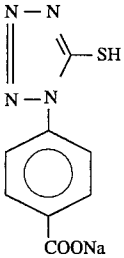

-continued

F-3

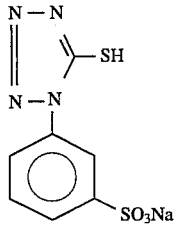

F-4

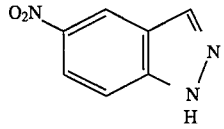

F-5

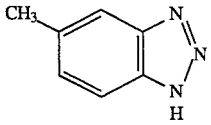

F-6

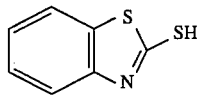

F-7

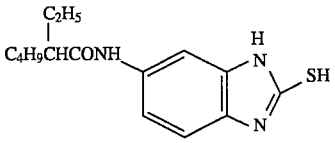

F-8

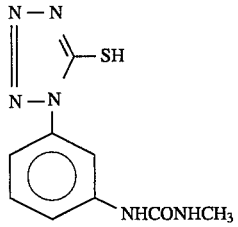

F-9

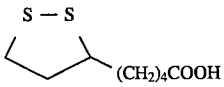

F-10

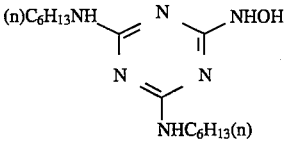

F-11

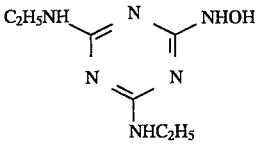

F-12

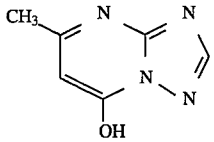

F-13

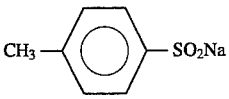

F-14

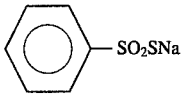

F-15

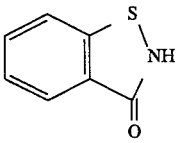

F-16

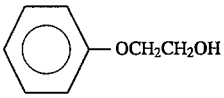

F-17

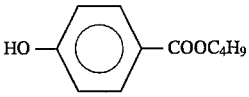

Sample Nos. 302 to 315 were prepared in the same manner as in preparation of Sample No. 301, except that ExY-1 in the seventh and eighth layers was replaced by the same molar amount of the DIR compound shown in Table 5 below and that ExY-1 in the eleventh layer was replaced by the same DIR compound in such a way that the characteristic curve of the yellow density of each sample to be obtained by wedgewise exposing the sample to a white light at 4800° K. followed by developing it according to the process mentioned below might be almost the same as the characteristic curve of the same of Sample No. 301 to be obtained in the same manner.

TABLE 6

| Sample No. | Added to 7th, 8th and 11th Layers | Degree of Color Turbidity | RMS Value | Remarks |
|---|---|---|---|---|
| 301 | ExY-1 | −0.11 | 0.025 | Comparison |
| 302 | D-b | −0.12 | 0.024 | Comparison |
| 303 | D-d | −0.09 | 0.030 | Comparison |
| 304 | D-2 | −0.20 | 0.021 | Invention |
| 305 | D-3 | −0.23 | 0.019 | Invention |
| 306 | D-5 | −0.16 | 0.021 | Invention |
| 307 | D-6 | −0.18 | 0.021 | Invention |
| 308 | D-10 | −0.21 | 0.020 | Invention |
| 309 | D-14 | −0.16 | 0.022 | Invention |
| 310 | D-16 | −0.17 | 0.021 | Invention |
| 311 | D-21 | −0.17 | 0.020 | Invention |
| 312 | D-23 | −0.22 | 0.022 | Invention |
| 313 | D-30 | −0.23 | 0.020 | Invention |
| 314 | D-41 | −0.22 | 0.019 | Invention |

DIR Compound

| | | | | |
|---|---|---|---|---|
| 315 | D-49 | −0.18 | 0.021 | Invention |

These samples were imagewise exposed to a blue light, then uniformly exposed to a green light in such a way that the magenta density in the region of not exposed to the blue light in Sample No. 301 might be 1.7, and processed according to the process described below. In each of the thus-processed samples, the color turbidity was obtained, corresponding to the value calculated by subtracting the magenta density in the yellow-fogged region from the magenta density at the point giving an yellow density of 2.2.

The smaller the value thus obtained, the smaller the color turbidity. Samples having a smaller color turbidity have a higher color saturation.

On the other hand, each sample was exposed to a white light at 4800° K. and then processed according to the process mentioned below. The graininess of each of the thus-processed samples was measured by the conventional RMS method. The RMS value was measured at the point having an yellow density of fog plus 0.4, using a 48 μm-circular aperture.

The samples each were cut to have a width of 35 mm, exposed with a camera and processed according to the process described below at a rate of one $m^2$ a day over a period of 15 days.

To process the exposed samples, an automatic developing machine, Model FP-560B (made by Fuji Photo Film Co.) was used.

The processing steps and the compositions of the processing solutions to be used therein are described below.

Processing Steps

| Step | Time | Temperature | Amount of Replenisher* | Tank Capacity |
|---|---|---|---|---|
| Color Development | 3 min 5 sec | 38.0° C. | 23 ml | 17 liters |
| Bleaching | 50 sec | 38.0° C. | 5 ml | 5 liters |
| Blixation | 50 sec | 38.0° C. | — | 5 liters |
| Fixation | 50 sec | 38.0° C. | 16 ml | 5 liters |
| Rinsing with water | 30 sec | 38.0° C. | 34 ml | 3.5 liters |
| Stabilization (1) | 20 sec | 38.0° C. | — | 3 liters |
| Stabilization (2) | 20 sec | 38.0° C. | 20 ml | 3 liters |
| Drying | 1 min 30 sec | 60° C. | | |

*Amount of replenisher was per 1.1 m of the 35 mm-wide sample (corresponding to one 24-exposure roll film).

The stabilization was effected by a countercurrent piping system from the tank (2) to the tank (1). All the overflow from the rinsing water was returned back to the fixation bath. The top of the bleaching bath and that of the fixation bath of the automatic developing machine used in the present example were both notched so that all the overflows from the bleaching bath and the fixation bath to be generated by replenishment to the both bathes were introduced into the blixation bath. The amount of the carryover from the developer bath to the bleaching bath, that of the carryover from the bleaching bath to the blixation bath, that of the carryover from the blixation bath to the fixation bath, and that of the carryover from the fixation bath to the rinsing bath were 2.5 ml, 2.0 ml, 2.0 ml and 2.0 ml, respectively, per 1.1 m of the 35 mm-wide sample being processed. The cross-over time between the adjacent bathes was all 6 seconds, and the time was included in the processing time in the previous step.

The compositions of the processing solutions used above are mentioned below.

| | Tank Solution | Replenisher |
|---|---|---|
| Color Developer | | |
| Diethylenetriamine-pentaacetic Acid | 2.0 g | 2.0 g |
| 1-Hydroxyethylidene-1,1-diphosphonic Acid | 2.0 g | 2.0 g |
| Sodium Sulfite | 3.9 g | 5.1 g |
| Potassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Mehtyl-4-[N-ethyl-N-(β-hydroxyethyl)amino]aniline Sulfate | 4.5 g | 6.0 g |
| Water to make | 1.0 liter | 1.0 liter |
| pH (adjusted with potassium hydroxide and sulfuric acid) | 10.05 | 10.05 |
| Bleaching Solution: | | |
| Ammonium 1,3-Diaminopropane-tetraacetato/Fe (III) Monohydrate | 130 g | 195 g |
| Ammonium Bromide | 70 g | 105 g |
| Ammonium Nitrate | 14 g | 21 g |
| Hydroxyacetic Acid | 25 g | 38 g |
| Acetic Acid | 40 g | 60 g |
| Water to make | 1.0 liter | 1.0 liter |
| pH (adjusted with aqueous ammonia) | 4.4 | 4.0 |

Blixer:

A solution of a mixture of 15/85 (by volume) of the above-described bleaching solution and the following fixation tank solution. pH: 7.0

| Fixer: | Tank Solution | Replenisher |
|---|---|---|
| Ammonium Sulfite | 19 g | 57 g |
| Aqueous Solution of Ammonium Thiosulfate (700 g/liter) | 280 ml | 840 ml |
| Imidazole | 15 g | 45 g |
| Ethylenediamine-tetraacetic Acid | 15 g | 45 g |
| Water to make | 1.0 liter | 1.0 liter |
| pH (adjusted with aqueous ammonia and acetic acid) | 7.4 | 7.45 |

Rinsing Water

A city water was passed through a mixed bed type column filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 mg/liter of sodium dichloroisocyanurate were added to the resulting water, which had a pH value falling within the range of from 6.5 to 7.5. This was used as the rinsing water.

Stabilizing Solution
Tank solution and replenisher were the same.

| | |
|---|---|
| Sodium P-toluenesulfinate | 0.03 g |
| Polyoxyethylene P-monononylphenyl Ether (mean degree of polymerization: 10) | 0.2 g |
| Disodium Ethylenediamine-tetraacetate | 0.05 g |
| 1,2,4-Triazole | 1.3 g |
| 1,4-Bis(1,2,4-triazol-1-ylmethyl)-piperazine | 0.75 g |

-continued

| Stabilizing Solution<br>Tank solution and replenisher were the same. | |
|---|---|
| Water to make | 1.0 liter |
| pH | 8.5 |

From Table 6 above, it is understood that Sample Nos. 304 to 315 each containing the DIR compound of the present invention were superior to Sample Nos. 301, 302 and 303 each containing the known DIR compound in that the former had a smaller magenta turbidity in the yellow density region, a higher color saturation, a smaller RMS value and a higher graininess than the latter.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide emulsion layer and at least one compound represented by a general formula (I) on a support:

$$A\text{-}(TIME)_m\text{-}(RED)_n\text{-}Q \quad (I)$$

wherein A represents a group capable of releasing $(TIME)_m$-$(RED)_n$-Q' by a reaction with an oxidation product of an aromatic primary amine developing agent;

TIME represents a timing group capable of releasing $(RED)_n$-Q after having been released from A;

RED represents a group capable of releasing Q by reaction with an oxidation product of an aromatic primary amine developing agent after having been released from TIME;

Q represents a group of the following general formula (II);

m represents 0, 1 or 2;

n represents 0 or 1; and when m is 2, two TIME groups may be the same or different:

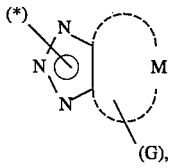

(II)

wherein M has at least one hetero atom selected from the group consisting of oxygen, sulfur and nitrogen atoms and represents a non-metallic atomic group necessary for forming a 5-membered, 6-membered or 7-membered hetero-ring along with the two carbon atoms in the 1,2,3-triazole ring moiety in the formula; G represents a substituent;

f represents 0 or an integer of from 1 to 5; and when f is 2 or more, two or more G groups may be the same or different; and (*) indicates the position at which the group bonds to A-$(TIME)_m$-$(RED)_n$-;

wherein the at least one hetero atom in M in formula (II) is (1) at least one nitrogen atom and at least one oxygen or sulfur atom or (2) at least one nitrogen atom;

wherein A is a coupler residue selected from the group consisting of pivaloylacetanilides, benzoylacetanilides, malonic diesters, malondiamides, dibenzoylmethanes, benzothiazolylacetamides, malonic ester monoamides, benzoxazolylacetamides, benzimidazolylacetamides, cylcoalkanoylacetamides, 5 -pyrazolone, pyrazolobenzimidazoles, pyrazolotriazoles, pyrazoloimidazoles, imidazotriazoles, cyanoacetophenones, phenols, naphthols, indanones and acetophenones.

2. The silver halide photographic material as claimed in claim 1, wherein said substituent represented by G is selected from the group consisting of a halogen atom, a hydroxyl group, a cyano group, a nitro group, -COOX (wherein X represents H, an alkali metal atom, or $NH_4$-), an alkyl group, an aryl group, an alkoxy group, an aryloxy group, an alkoxycarbonyl group, an aryloxycarbonyl group, an acylamino group, carbamoyl group, a sulfamoyl group, an alkoxycarbonylamino group, an alkylthio group, an arylthio group, an aryloxycarbonylamino group, an alkylcarbonyloxy group, a ureido group, a heterocyclic group, an acyl group, a sulfonyl group, and an imido group, wherein said groups may be substituted by at least one of said substituents.

3. The silver halide photographic material as claimed in claim 1, wherein TIME represents a group represented by formula (T-1), (T-2) or (T-3);

$$*\text{-}W\text{-}(X{=}Y)_j\text{-}C(R_{31})R_{32}\text{-}** \quad (T\text{-}1)$$

$$*\text{-}W\text{-}CO\text{-}** \quad (T\text{-}2)$$

$$*\text{-}W\text{-}LINK\text{-}E\text{-}** \quad (T\text{-}3)$$

wherein * indicates the position at which the group bonds to A in formula (I); ** indicates the position at which the group bonds to (RED)-Q or to TIME (when m is a plural number) in the same; W represents an oxygen atom, a sulfur atom or >N-$R_{33}$; X and Y each represents a substituted or unsubstituted methine group or a nitrogen atom; j represents 0, 1 or 2; and $R_{31}$, $R_{32}$, and $R_{33}$ each represents a hydrogen atom or a substituent; two of the substituents of X, Y, $R_{31}$, $R_{32}$, and $R_{33}$ may be bonded to each other to form a cyclic structure;

wherein E represents an electrophilic group, and LINK represents a linking group for attaining a steric relationship between W and E for an intramolecular nucleophilic substitution reaction therebetween.

4. The silver halide photographic material as claimed in claim 3, wherein the substituent of said substituted methine group represented by X and Y and said substituent represented by $R_{31}$, $R_{32}$ and $R_{33}$ is selected from the group of a halogen atom, a hydroxyl group, a cyano group, a nitro group, -COOM (wherein M represents H, an alkali metal atom, or $NH_4$-), an alkyl group, an aryl group, an alkoxy group, an aryloxy group, an alkoxycarbonyl group, an aryloxycarbonyl group, an acylamino group, carbamoyl group, a sulfamoyl group, an alkoxycarbonylamino group, an alkylthio group, an arylthio group, an aryloxycarbonylamino group, an alkylcarbonyloxy group, an ureido group, a heterocyclic group, an acyl group, a sulfonyl group, and an imido group, said groups may be substituted by at least one of said substituents.

5. The silver halide photographic material as claimed in claim 1, where in the RED is a moiety selected from the group consisting of moieties of hydroquinones, catechols, pyrogallols, 1,2-naphthohydroquinones, 1,4-naphthohydroquinones, sulfonamidophenols, hydrazines and sulfonamidonaphthols.

6. The silver halide photographic material as claimed in claim 1, wherein hetero atoms in M in formula (II) consists of at least two nitrogen atoms.

7. The silver halide photographic material as claimed in claim 1, wherein Q in formula (I) is a group selected from the group consisting of groups represented by general formulae (Q-1), (Q-2), (Q-3), (Q-4), (Q-5), (Q-6), (Q-7), (Q-8), (Q-9), (Q-10), (Q-11), (Q-12), and (Q-13):

(Q-1)

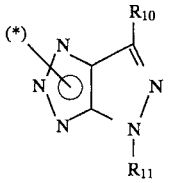

(Q-2)

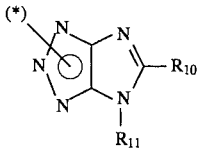

(Q-3)

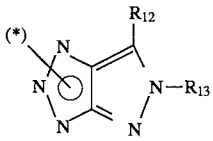

(Q-4)

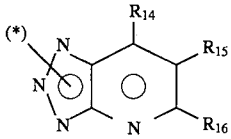

(Q-5)

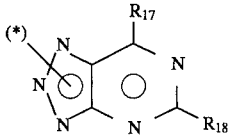

(Q-6)

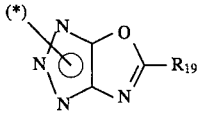

(Q-7)

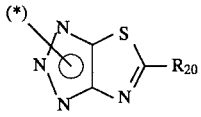

(Q-8)

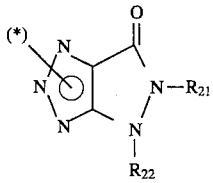

-continued (Q-9)

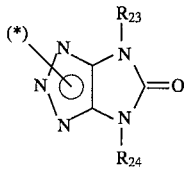

(Q-10)

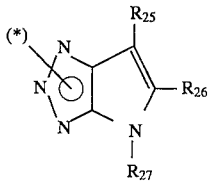

(Q-11)

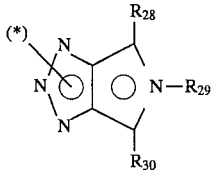

(Q-12)

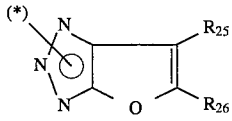

(Q-13)

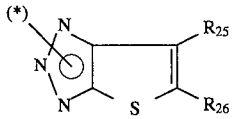

wherein $R_{10}$ to $R_{30}$ each represents a hydrogen atom or have the same meanings as those of G in formula (II), (*) indicates the position at which the group bonds to A-(TIME)$_m$-(RED)$_n$-, and A-(TIME)$_m$-(RED)$_n$- bonds to Q at any nitrogen atom in the 1,2,3-triazole ring in formulae (Q-1) to (Q-13).

8. The silver halide photographic material as claimed in claim 1, wherein the compound represented by formula (I) is incorporated into at least one of said light-sensitive silver halide emulsion layer(s) and the layer(s) adjacent to the light-sensitive silver halide emulsion layer(s).

9. The silver halide photographic material as claimed in claim 1, wherein the compound represented by formula (I) is incorporated into said at least one light-sensitive silver halide emulsion layer(s).

10. The silver halide photographic material as claimed in claim 1, wherein the compound represented by formula (I) is incorporated into the silver halide photographic material in an amount of from $3\times10^{-7}$ to $1\times10^{-3}$ mol/m$^2$.

* * * * *